US008568044B2

(12) United States Patent
Murata et al.

(10) Patent No.: US 8,568,044 B2
(45) Date of Patent: Oct. 29, 2013

(54) INK RIBBON CARTRIDGE

(75) Inventors: Kazuyoshi Murata, Kanagawa (JP); Noboru Koyama, Tokyo (JP); Shingo Hitose, Saitama (JP)

(73) Assignee: Sony Corporation, Tokyo (JP)

( * ) Notice: Subject to any disclaimer, the term of this patent is extended or adjusted under 35 U.S.C. 154(b) by 523 days.

(21) Appl. No.: 12/656,930

(22) Filed: Feb. 19, 2010

(65) Prior Publication Data

US 2010/0272488 A1 Oct. 28, 2010

(30) Foreign Application Priority Data

Apr. 27, 2009 (JP) ..... 2009-108246

(51) Int. Cl.
*B41J 35/28* (2006.01)

(52) U.S. Cl.
USPC ..... 400/208; 400/207; 400/120.01; 347/214

(58) Field of Classification Search
USPC ..... 400/207, 208
See application file for complete search history.

(56) References Cited

U.S. PATENT DOCUMENTS 4,754,290 A * 6/1988 Kitayama et al. ..... 400/207
4,978,240 A * 12/1990 Katsuno ..... 347/214
5,128,763 A * 7/1992 Sakuragi ..... 400/208
5,709,485 A * 1/1998 Kohno ..... 400/208
5,769,547 A * 6/1998 Igarashi ..... 400/208
5,775,821 A * 7/1998 Kato ..... 400/207
6,504,564 B1 * 1/2003 Funaki et al. ..... 347/214
6,522,349 B1 * 2/2003 Lee ..... 347/214
D569,901 S * 5/2008 Jao ..... 347/214
7,736,076 B2 * 6/2010 Motoki ..... 400/208

FOREIGN PATENT DOCUMENTS

JP 2007-230158 9/2007

* cited by examiner

*Primary Examiner* — Jill Culler
(74) *Attorney, Agent, or Firm* — Rader, Fishman & Grauer PLLC

(57) ABSTRACT

An ink ribbon cartridge includes: a supply spool which has at one end portion a driving hole, with which a driving shaft of a printer apparatus is engaged; a winding spool which has at one end portion a driving hole, with which the driving shaft of the printer apparatus is engaged; and a cartridge main body which has a supply-side ribbon housing section, a winding-side ribbon housing section, and a thermal head entry opening portion formed between the supply-side and winding-side ribbon housing sections, and in which opening portions for the ribbon are formed on the head entry opening portion sides of the supply-side and winding-side ribbon housing sections, wherein in the cartridge main body, a concave guide portion is formed, and on a bottom face of the concave guide portion, a projection portion, which comes into contact with a guide portion of the printer apparatus side, is formed.

5 Claims, 14 Drawing Sheets

INK RIBBON CARTRIDGE

BACKGROUND OF THE INVENTION

1. Field of the Invention

The present invention relates to an ink ribbon cartridge which is used in a printer apparatus, in which a cartridge main body with an ink ribbon housed therein is mounted and a color material of the ink ribbon is then transferred to an image printing medium by a thermal head. More specifically, the present invention relates to an ink ribbon cartridge, in which a large amount of ink ribbon can be wound.

2. Description of the Related Art

As a printer apparatus which prints an image or a character on an image printing medium, there is a printer apparatus which prints a color image or a character by transferring a color material, which forms an ink layer provided on one side face of an ink ribbon, to an image printing medium. This printer apparatus is provided with a thermal head which transfers the color material of the ink ribbon to the image printing medium, and a platen which is provided at a position which faces the thermal head, and supports the ink ribbon and the image printing medium. This printer apparatus transfers the color material of the ink ribbon to the image printing medium by superposing the ink ribbon on the image printing medium between the thermal head and the platen and applying heat energy to the ink ribbon by the thermal head. In this way, the printer apparatus prints a color image or character.

The ink ribbon which is used in such a thermal transfer type printer apparatus is usually housed in a wound state in an ink ribbon cartridge. The ink ribbon cartridge has a supply spool and a winding spool, on which the ink ribbon is wound, and these spools are housed in a supply-side ribbon housing section and a winding-side ribbon housing section, which are provided in a cartridge main body, so as to be able to rotate. When the ink ribbon cartridge is mounted on a mounting section of the printer apparatus, the spools are rotated, so that the ink ribbon is drawn out from the supply spool. The ink ribbon travels along with the image printing medium between the thermal head and the platen, thereby being served for printing, and then, is wound on the winding spool.

But, in order to improve convenience of such a printer apparatus, it is preferable to increase the amount, that is, the number of windings, of the ink ribbon which is housed in the ink ribbon cartridge, so as to be able to print more images. On the other hand, considering compatibility with an existing printer apparatus, it is not possible to increase without limitation the size of the ink ribbon cartridge. It is necessary to make the ink ribbon cartridge a size allowing it to be mounted on a cartridge mounting section of an existing printer apparatus even with the number of windings of the ink ribbon increased. Therefore, in order to increase the number of windings of the ink ribbon while making the ink ribbon cartridge to have a size capable of be mounted on a cartridge mounting section of an existing printer apparatus, it is necessary to increase the number of windings of the ink ribbon without changing an outer shape or a size as far as possible.

In order to realize this, it is necessary to increase the volumes of the supply-side ribbon housing section and the winding-side ribbon housing section by making the thickness of the shell constituting the cartridge main body to be thin. However, if the shell constituting the cartridge main body is made to be thin in thickness, strength of the cartridge main body is reduced.

For example, a pair of shells, which is butted to each other so as to constitute the cartridge main body, is provided at butting end portions with staggered engagement pieces in order to prevent the butted shells from being out of alignment. If the shells are made to be thin in thickness, in accordance with this, the engagement pieces are made to be thin, and strength is also reduced. Therefore, when the engagement pieces are made to be thin, workability at the time when constituting the cartridge main body by butting a pair of shells is also reduced.

Also, if a pair of shells, which constitute the cartridge main body, are made to be thin in thickness, strength of the cartridge main body is reduced, so that the ribbon cartridge is bent and deformed by tension of the ink ribbon at the time of transport of the ink ribbon during image printing operation or the like. In that case, there is a fear that wrinkles or the like may occur in the ink ribbon which is sent from the supply spool. Also, there is a fear that the ink ribbon is wound on the winding spool with a bias to one side.

Also, in general, the supply spool and the winding spool are housed in the supply-side ribbon housing section and the winding-side ribbon housing section of the cartridge main body so as to have a certain degree of rattling and be able to rotate. The rattling is provided so as to make the driving shaft of the printer apparatus be smoothly engaged with a driving hole formed in one end portion of the spool. On the other hand, in order to prevent the ink ribbon wound on each spool from coming into contact with the inner face of each ribbon housing section, it is necessary to make each ribbon housing section be larger than a maximum winding diameter of each spool. That is, it is necessary to make each ribbon housing section be large in consideration of the rattling amount of the spool. In that case, the ink ribbon cartridge becomes too large, so that the cartridge may not be mounted on the mounting section of an existing printer apparatus.

An example of the above-described related art is disclosed in Japanese Unexamined Patent Application Publication No. 2007-230158.

SUMMARY OF THE INVENTION

Therefore, the present invention addresses the above-identified problems and provides a novel ink ribbon cartridge which can be mounted on the cartridge mounting section of an existing printer apparatus, and also, can further increase the number of windings of an ink ribbon over those in an ink ribbon cartridge in the past.

According to an embodiment of the present invention, there is provided an ink ribbon cartridge including: a supply spool, on which an ink ribbon is wound and which is formed at one end portion with a driving hole, with which the driving shaft of a printer apparatus is engaged; a winding spool which takes up the ink ribbon sent from the supply spool and which is formed at one end portion with a driving hole, with which a driving shaft of the printer apparatus is engaged; and a cartridge main body which has a supply-side ribbon housing section which houses the supply spool so as to be able to rotate, and a winding-side ribbon housing section which houses the winding spool so as to be able to rotate, and in which a head entry opening portion, into which a thermal head enters, is formed between the supply-side ribbon housing section and the winding-side ribbon housing section, and opening portions for the ribbon, which make the ink ribbon extend in the head entry opening portion, are formed on the head entry opening portion side of the supply-side ribbon housing section and the head entry opening portion side of the winding-side ribbon housing section. In the cartridge main body, a concave guide portion acting when mounting the cartridge on a mounting section of the printer apparatus in an insertion direction into the printer apparatus is formed, and on a bottom face of the concave guide portion, a projection portion, which comes into contact with a guide portion of the printer apparatus side, which is engaged with the concave guide portion, is formed.

According to the present invention, even if portions where the supply-side ribbon housing section and the winding-side ribbon housing section are formed are made to be thin in thickness, thereby increasing volumes, since the projection portion which comes into contact with a guide portion of the printer apparatus side is formed on the bottom face of the concave guide portion which guides insertion into the printer apparatus, reduction in strength of the cartridge main body can be prevented.

BRIEF DESCRIPTION OF THE DRAWINGS

FIGS. 6A and 6B are cross-sectional views of the supply spool and the winding spool, wherein FIG. 6A shows an example in the past and FIG. 6B shows that in an embodiment of the present invention.

FIGS. 7A and 7B are plan views showing the relationship between a driving shaft of the printer apparatus and a driving hole of the spool, wherein FIG. 7A shows an example in the past and FIG. 7B shows that in an embodiment of the present invention.

FIGS. 8A and 8B are cross-sectional views showing the relationship between the driving shaft of the printer apparatus and the driving hole of the spool, wherein FIG. 8A shows an example in the past and FIG. 8B shows that in an embodiment of the present invention.

FIG. 9A to 9C are cross-sectional views showing a joined state of upper and lower shells, wherein FIG. 9A shows an example in the past, FIG. 9B shows a case where the thicknesses of the shells are thinner than those in an example in the past, and FIG. 9C shows the joined state in an embodiment of the present invention.

FIGS. 14A and 14B are side views conceptually showing a state of a flap constituting a transport mechanism of the printer apparatus, wherein FIG. 14A shows a state of the flap when an image printing medium is drawn in from a supply tray and FIG. 14B shows a state of the flap during image printing operation and at the time of discharging.

FIGS. 15A and 15B are diagrams showing the relationship between an ink ribbon and a thermal head, wherein FIG. 15A shows a state at the time of non-printing in which the thermal head does not come into contact with the ink ribbon, and FIG. 15B shows a state at the time of image printing in which the thermal head comes into contact with the ink ribbon.

DESCRIPTION OF THE PREFERRED EMBODIMENTS

Hereinafter, an ink ribbon cartridge according to an embodiment of the present invention will be explained in the following order with reference to the drawings.

1. Explanation of Outline
2. Explanation of Ink Ribbon Cartridge
2-1. Explanation of Ink Ribbon
2-2. Explanation of Spools
2-3. Explanation of Cartridge Main Body
2-4. Explanation of Supply-side Ribbon Housing Section
2-5. Explanation of Ribbon Guide Portion
2-6. Explanation of Concave Guide Portion
2-7. Explanation of Winding-side Ribbon Housing Section
2-8. Explanation of Supply-side Flat Portion and Winding-side Flat Portion
3. Explanation of Thermal Transfer Type Printer Apparatus
3-1. Explanation of Cartridge Mounting Section
3-2. Explanation of Thermal Head and Platen
3-3. Explanation of Transport Mechanism of Image Printing Medium 150
4. Explanation of Operation
5. Explanation of Effects
5-1. Effect 1
5-2. Effect 2
6. Modified Example

1. Explanation of Outline

Figure 1:
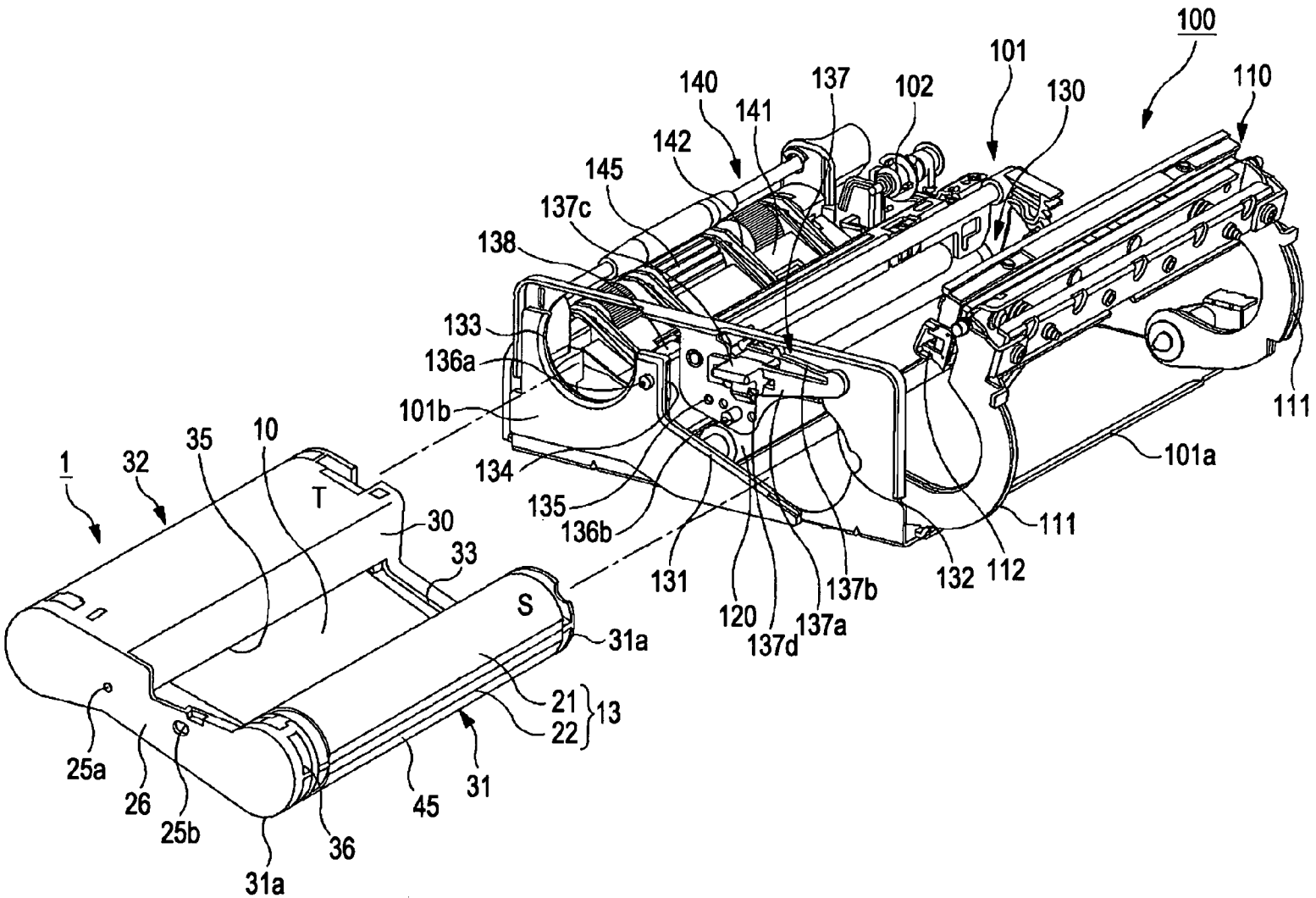
FIG. 1 is a perspective view of an ink ribbon cartridge and a printer apparatus.

As shown in FIG. 1, an ink ribbon cartridge 1 according to an embodiment of the present invention is mounted on a thermal transfer type printer apparatus 100 which prints a color image or a character by transferring a color material, which forms an ink layer provided on one side face of an ink ribbon, to an image printing medium. The printer apparatus 100 includes a thermal head 110 which transfers the color material of the ink ribbon to the image printing medium, and a platen 120 which is provided at a position that faces the thermal head 110, and supports the ink ribbon and the image printing medium. The thermal transfer type printer apparatus 100 transfers the color material of the ink ribbon to the image printing medium by superimposing the ink ribbon on the image printing medium between the thermal head 110 and the platen 120 and applying heat energy to the'ink ribbon by the thermal head 110. In this way, the thermal transfer type printer apparatus 100 prints a color image or a character.

In an apparatus main body 101 constituting the printer apparatus 100, in the inside thereof, there is formed a cartridge mounting section 130, on which the ink ribbon cartridge 1 is mounted. The cartridge mounting section 130 is formed with a cartridge insertion and removal opening 131 formed on the side face of the apparatus main body 101. The ink ribbon cartridge 1 is mounted on the cartridge mounting section 130 in the apparatus main body 101 from the cartridge insertion and removal opening 131.

On the lower front side of the printer apparatus 100, a supply tray which stocks the image printing media is mounted. The printer apparatus 100 draws the image printing medium stored in the supply tray into the apparatus main body 101. In the inside of the apparatus main body 101, a traveling path of the image printing medium is formed over a range from the front face to the back face side of the apparatus main body 101, and in the middle of the traveling path, the thermal head 110 and the platen 120 are disposed facing each other. The printer apparatus 100 moves the image printing medium drawn in from the supply tray and performs image printing on the traveling image printing medium. If the image printing is finished, then, the printer apparatus 100 discharges the printed image printing medium from a discharge port provided above the supply tray of the apparatus main body 101.

In the apparatus main body 101 of the printer apparatus 100, there is provided a slot for recording media, in which the recording media such as a memory card is mounted, or a wired or wireless interface for performing communication with an electronic device provided with a recording medium, such as a digital still camera. In addition, as the wired or wireless interface, a USB (Universal Serial Bus), an IEEE1394, or the like may be used. In the printer apparatus, image data is input from a recording medium mounted in the slot for recording media, or an electronic device connected through the wired or wireless interface, so that image printing is performed on the image printing medium.

2. Explanation of Ink Ribbon Cartridge

Figure 2:
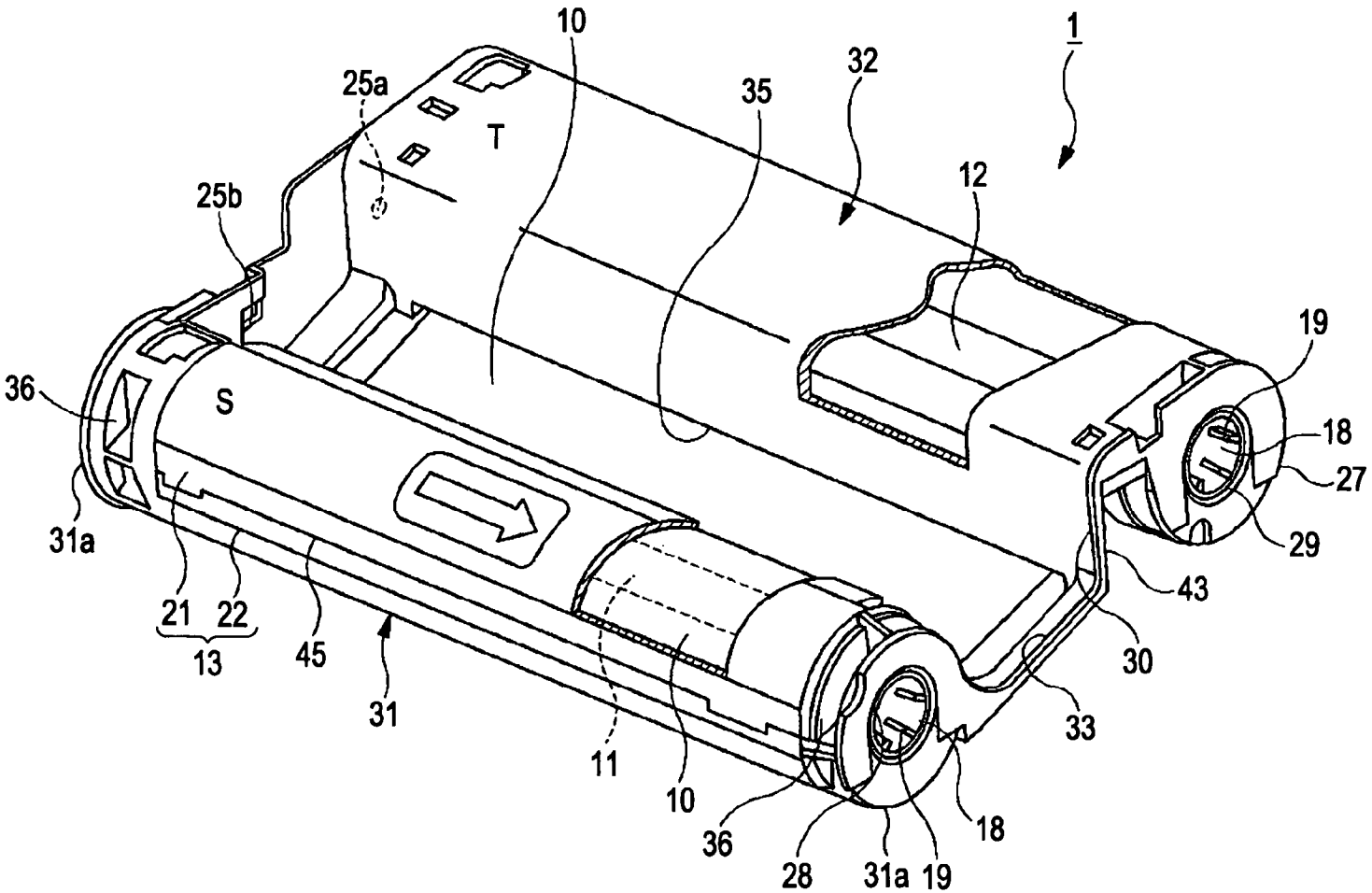
FIG. 2 is a perspective view of the ink ribbon cartridge, as viewed from an upper side.
Figure 3:
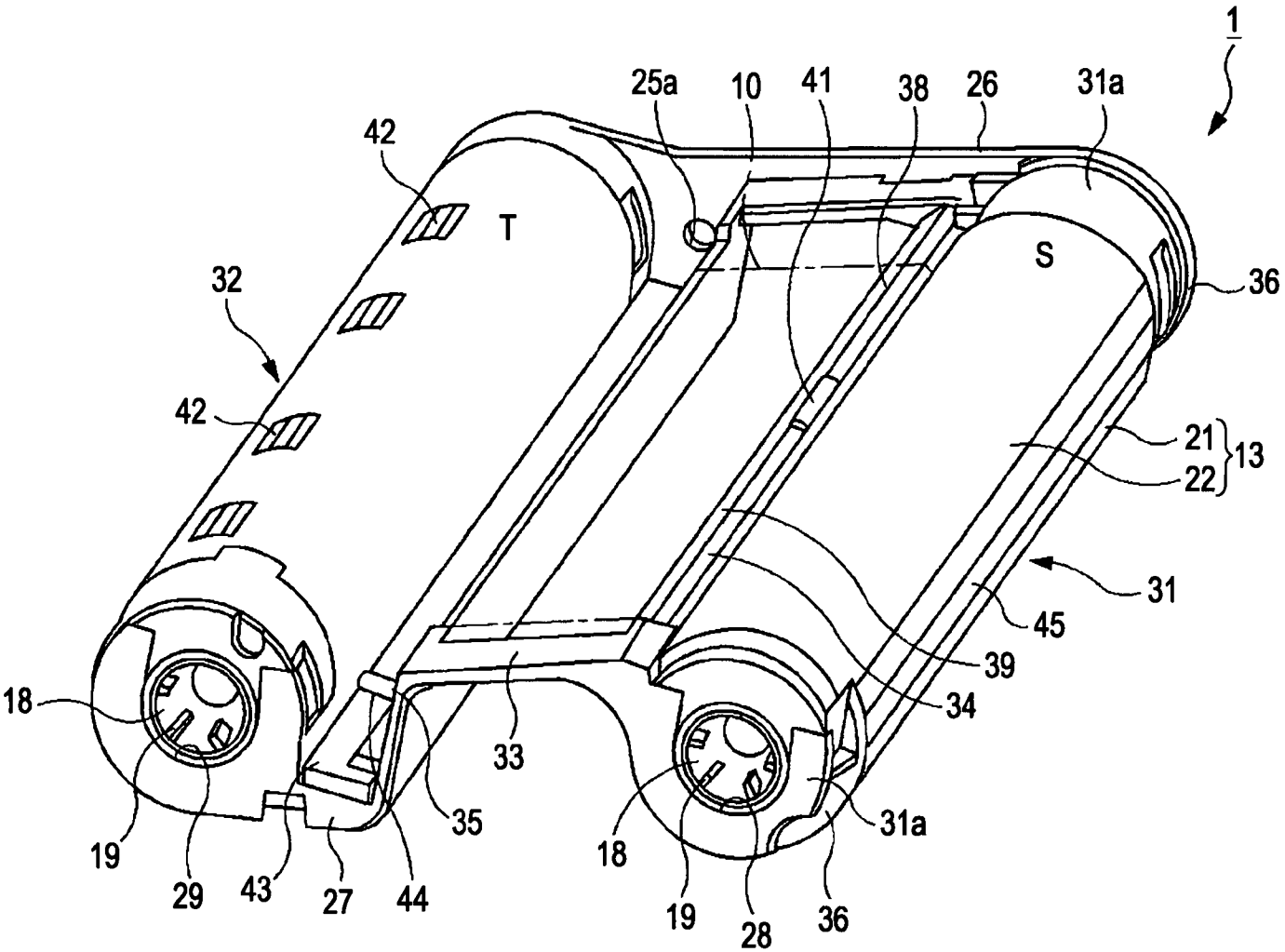
FIG. 3 is a perspective view of the ink ribbon cartridge, as viewed from a lower side.
Figure 4:
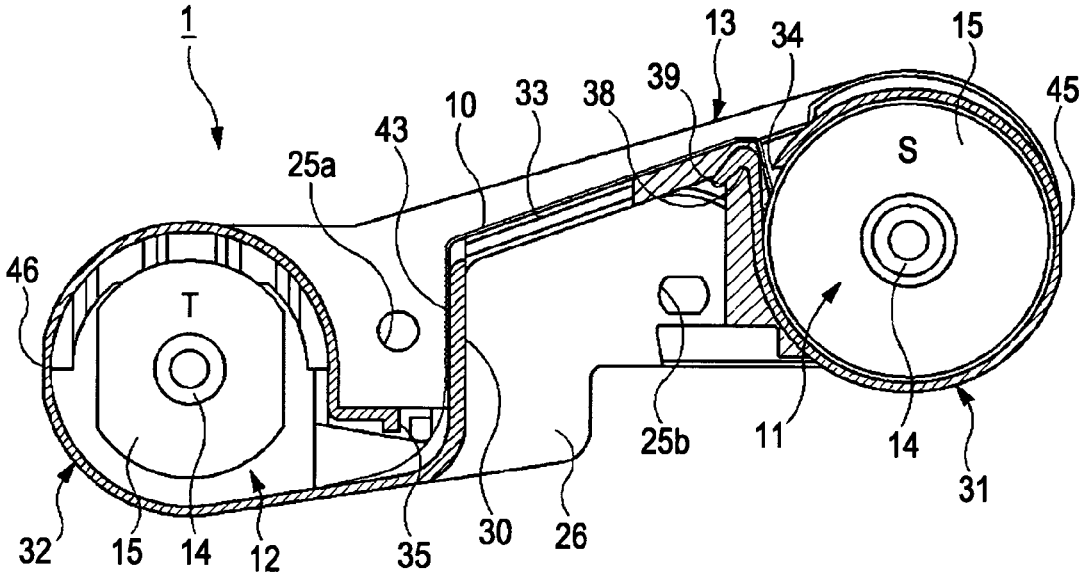
FIG. 4 is a cross-sectional view of the ink ribbon cartridge.

The ink ribbon cartridge 1 according to an embodiment of the present invention is provided with a supply spool 11 which supplies an ink ribbon 10, a winding spool 12 which takes up the ink ribbon 10, and a cartridge main body 13 which houses these spools 11 and 12 so as to be able to rotate, as shown in FIGS. 2 to 4.

An ink ribbon cartridge in the past contains an ink ribbon for 40 pieces of image printing media, whereas the ink ribbon cartridge 1 contains the ink ribbon 10 for 60 pieces of image printing media. Also, the ink ribbon cartridge 1 can be used also with respect to an existing printer apparatus 100. In order to increase the number of windings of the ink ribbon 10, the ink ribbon cartridge 1 is made to be larger in outer shape than that in the past in the range of allowing it to be mounted on the cartridge mounting section 130 of the printer apparatus 100, as described below. Along with this, thinning in thickness of the cartridge main body 13, and so on are realized. Further, the ink ribbon cartridge 1 is configured to contain in the inside thereof more ink ribbon 10 than in the past, specifically, the ink ribbon for 60 pieces of image printing media which is more than in the past.

2-1. Explanation of Ink Ribbon

The ink ribbon 10 has dye layers provided on one side face of a base material made of a synthetic resin film such as a polyester film or a polystyrene film. Specifically, on one side face of the base material, the dye layers formed of dyes of the respective colors of yellow (Y), magenta (M), and cyan (C), which form an image, and thermoplastic resin, and protection layers formed of the same thermoplastic resin as that of the dye layer are repeatedly provided in order at regular intervals in a longitudinal direction. Also, on the base material, the dye layer and the protection layer, which constitute 1 set, are formed to be arranged in order in a longitudinal direction. The dye layer and the protection layer are sublimed and thermal-transferred in sequence to a receptor layer of an image printing paper, which will be described later, by applying heat energy corresponding to image data to be printed, by the thermal head 110.

In the ink ribbon 10 as described above, the dye layers of yellow (Y), magenta (M), and cyan (C), and the protection layers are used in printing of one piece of image. The ink ribbon 10 is fixed at one end portion thereof to the supply spool 11 and at the other end portion thereof to the winding spool 12 and, in accordance with the progress of image printing, is sequentially supplied from the supply spool 11 and wound on the winding spool 12.

Also, as long as the ink ribbon 10 which is used in the present invention has at least one dye layer and the protection layer, other configurations are not to be particularly limited. For example, the ink ribbon 10 may also be constituted by the dye layer of black (K) and the protection layer, or may also be constituted by the dye layers of yellow (Y), magenta (M), and cyan (C), and black (K) and the protection layers.

2-2. Explanation of Spools

Each of the supply spool 11 and the winding spool 12, on which the ink ribbon 10 which is constituted as described above is wound, has a shaft portion 14, on which the ink ribbon 10 is wound, and flange portions 15 and 15 are formed on both sides of the shaft portion 14, as shown in FIGS. 4 to 6B. To the shaft portion 14 of the supply spool 11, one end portion of the ink ribbon 10 is fixed by an adhesive agent or a fixing member, and to the shaft portion 14 of the winding spool 12, the other end portion of the ink ribbon 10 is fixed by an adhesive agent or a fixing member. The flange portions 15 and 15 perform regulation of a winding position in an axial direction of the ink ribbon 10 which is wound on the shaft portions 14.

Figure 6A:
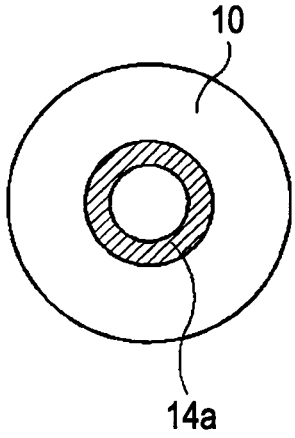
Figure 6B:
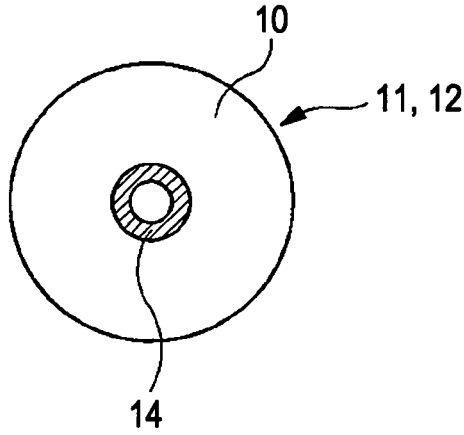

In addition, as shown in FIG. 6B, in the supply spool 11 and the winding spool 12, which are used in the ink ribbon cartridge 1 according to an embodiment of the present invention, the thickness of the shaft portion 14 is made to be thinner than that in an ink ribbon cartridge in the past, so that the number of windings of the ink ribbon 10 is increased. Incidentally, FIG. 6A shows the relationship between a shaft portion 14*a* and an ink ribbon 10*a* wound thereon in an ink ribbon cartridge in the past. Also, FIG. 6B shows the relationship between the shaft portion 14 and the ink ribbon 10 wound thereon in the ink ribbon cartridge according to an embodiment of the present invention.

On the shaft portions 14 of the supply spool 11 and the winding spool 12, which are constituted as described above, the ink ribbon 10 is wound in such a manner that a face with the dye layers of yellow (Y), magenta (M), and cyan (C) and the protection layers formed thereon is located inside.

Figure 5:
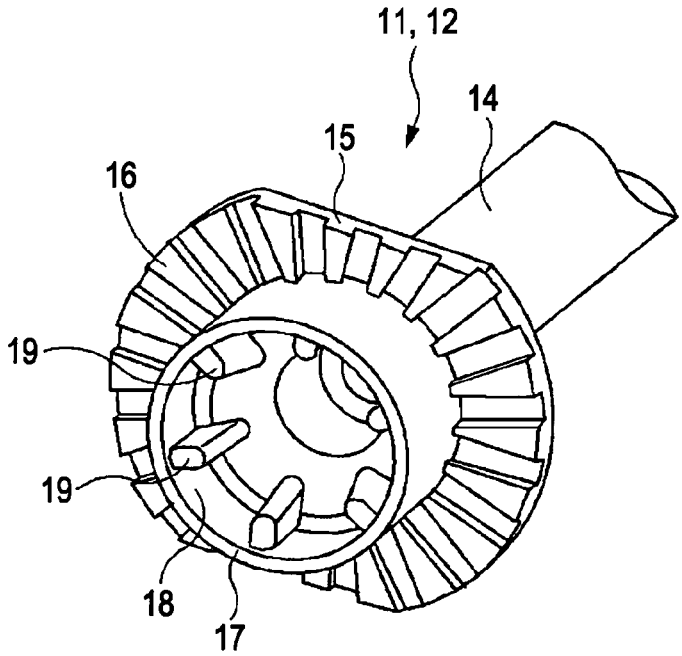
FIG. 5 is a perspective view of main portions of a supply spool and a winding spool.

In addition, as shown in FIG. 5, in the flange portion 15 on one side, a gear portion 16 is formed in a face on the opposite side to a side on which the ink ribbon 10 is wound. The gear portion 16 is engaged with a locking projection formed in the inner face of the cartridge main body 13. That is, the supply spool 11 or the winding spool 12 is housed in the cartridge main body 13 while having a certain degree of rattling with respect to the cartridge main body 13. Also, each of these spools 11 and 12 is biased from an end portion on the opposite side to the gear portion 16 by a biasing member such as a coil spring such that the gear portion 16 is engaged with the locking projection. In this way, the supply spool 11 or the winding spool 12 is not freely rotated at the time of non-use.

When the cartridge is mounted on the cartridge mounting section 130 of the printer apparatus 100, the supply spool 11 or the winding spool 12 is pressed against a driving shaft 102 or 102 of the cartridge mounting section 130, so that the engagement state of the gear portion 16 with the locking projection is released. In this way, the supply spool 11 or the winding spool 12 is in a state where the spool can be rotated by the driving shafts 102 or 102.

Figure 7A:
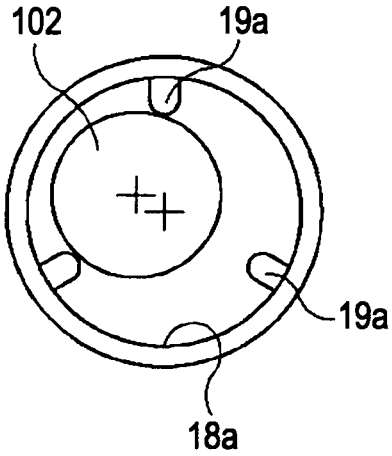
Figure 7B:
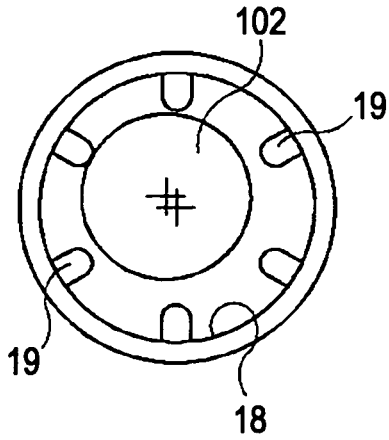

As shown in FIG. 5, in the supply spool 11 and the winding spool 12, a tubular portion 17 facing outside is formed on one side flange portion 15 on a side on which the gear portion 16 is provided, and a driving hole 18 is formed in the tubular portion 17. The driving shaft 102 or 102 provided in the cartridge mounting section 130 of the printer apparatus 100 enters into and is engaged with the driving hole 18. In the driving hole 18, as shown in FIG. 7B, a plurality of, here, six, projecting pieces 19 which is engaged with driving pieces of the driving shaft 102 or 102 are provided at equal intervals. In a driving hole 18*a* which is provided in a supply spool or a winding spool of an ink ribbon cartridge in the past, three projecting pieces 19*a* are provided at equal intervals, as shown in FIG. 7A. In the driving hole 18 of the ink ribbon cartridge 1 according to an embodiment of the present invention, the number of projecting pieces 19 is increased from three pieces to six pieces. Therefore, the driving hole 18 reduces the amount of displacement of the supply spool 11 or the winding spool 12 with respect to the driving shaft 102 or 102, so that a position of the supply spool 11 or the winding spool 12 can be easily determined. In this way, center shift of the supply spool 11 or the winding spool 12 with respect to the driving shaft 102 or 102 is reduced, so that the positions thereof become more stable and rotation movement thereof also becomes smoother.

Figure 8A:
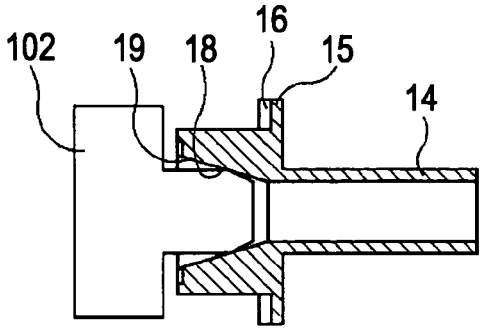
Figure 8B:
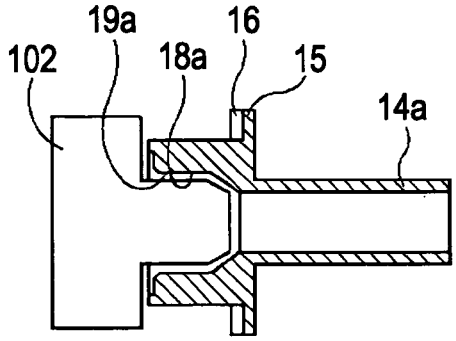

Also, the projecting pieces 19 to be formed in the driving hole 18 are formed such that edge portions on the center side of the driving hole 18 form a diameter which is enlarged toward an opening end of the driving hole 18, as shown in FIG. 8A. That is, the projecting piece 19 is formed such that the width is narrowed toward the opening end, or the edge portion on the center side of the driving hole 18 is inclined. Here, the bottom face side of the driving hole 18 of the projecting piece 19 is smaller than a diameter of the driving shaft 102 or 102. In this way, the projecting piece 19 necessarily comes into contact with the circumferential surface of the driving shaft 102 or 102. As shown in FIG. 8B, in the past, since the driving hole 18*a* and the projecting piece 19*a* are parallel to the circumferential surface of the driving shaft 102 or 102 and a gap exists, rattling occurs between the driving shaft 102 or 102 and the driving hole 18*a*. However, in an example of FIG. 8A to which an embodiment of the present invention is applied, since the driving hole 18 and the projecting piece 19 necessarily comes into contact with the circumferential surface of the driving shaft 102 or 102, rattling can be prevented.

As described above, in the driving hole 18 of the ink ribbon cartridge 1, the number of projecting pieces 19 is increased compared to that in the past, and further, the projecting piece 19 is formed into an inclined shape. Therefore, the position of the supply spool 11 or the winding spool 12 is stable with respect to the driving shaft 102 or 102. Also, gaps between the ink ribbon 10 wound on the supply spool 11 or the winding spool 12 and the inner faces of the cartridge main body 13, that is, the inner faces of the supply-side and winding-side ribbon housing sections are reduced. Therefore, much ink ribbon 10 can be wound on the supply spool 11 or the winding spool 12.

2-3. Explanation of Cartridge Main Body

The cartridge main body 13 which houses the supply spool 11 and the winding spool 12, which are as described above, so as to be able to rotate, is constituted by butting and combining an upper shell 21 and a lower shell 22, as shown in FIGS. 2 to 4.

Figure 9A:
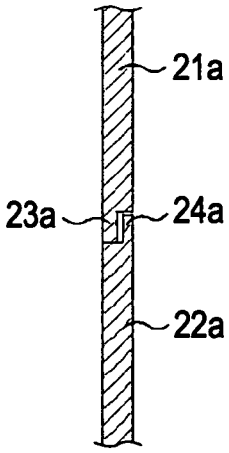
Figure 9B:
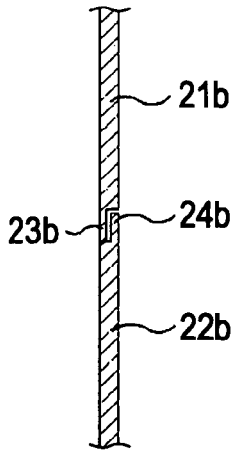
Figure 9C:
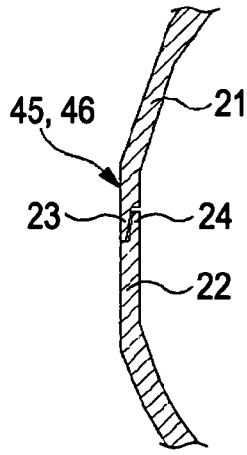

As shown in FIG. 9C, engagement pieces 23 and 24 which are continuously or intermittently engaged with each other are respectively formed at butting end portions of the upper shell 21 and the lower shell 22. The engagement piece 23 of the upper shell 21 is located outside the cartridge main body 13, and the engagement piece 24 of the lower shell 22 is located inside the cartridge main body 13. The respective engagement pieces 23 and 24 are formed such that base ends are thick in thickness and faces facing each other are sloping faces. That is, the engagement pieces 23 and 24 are formed to be approximately a trapezoidal shape in cross-section. In this manner, since the base ends of the engagement pieces 23 and 24 are thickened, even if the upper shell 21 and the lower shell 22 are formed to be thin in thickness, strength can be secured, and also, a mutual contact area can also be sufficiently secured.

FIG. 9A shows an upper shell 21*a* and a lower shell 22*a* in the past, and the upper shell 21*a* and the lower shell 22*a* are formed to be thick in thickness, as in the past. Therefore, engagement pieces 23*a* and 24*a* are thick. FIG. 9B shows a case where an upper shell 21*b* and a lower shell 22*b* are formed to be thinner in thickness than in the past in order to increase the number of windings of the ink ribbon 10 on the supply spool 11 or the winding spool 12. Therefore, engagement pieces 23*b* and 24*b* are thin. FIG. 9C shows a case where the upper shell 21 and the lower shell 22 is formed to be thinner in thickness than that in FIG. 9A, and also, the engagement pieces 23 and 24 are formed to be approximately a trapezoidal shape in cross-section. In FIG. 9C to which an embodiment of the present invention is applied, by forming the engagement pieces 23 and 24 to be approximately a trapezoidal shape in cross-section, even though the upper shell 21 and the lower shell 22 are formed to be thinner in thickness than that in FIG. 9A, strength of the engagement pieces 23 and 24 is secured.

In addition, the upper shell 21 and the lower shell 22 are integrated by joining the engagement pieces 23 and 24 by an adhesive agent, ultrasonic welding, or the like.

As described above, the cartridge main body 13, in which the upper shell 21 and the lower shell 22 are butted and combined, has approximately a rectangular shape as a whole, as shown in FIGS. 2 to 4, and a supply-side ribbon housing section 31 and a winding-side ribbon housing section 32 are formed parallel to each other in a longitudinal direction. As shown in FIG. 4, by making portions, in which the supply-side ribbon housing section 31 and the winding-side ribbon housing section 32 are formed, to be thinner in thickness than in the past, the number of windings of the ink ribbon 10 on the supply spool 11 or the winding spool 12 is increased. On the other hand, a portion between the supply-side ribbon housing section 31 and the winding-side ribbon housing section 32 is formed to have the same thickness as that in the past, so that reduction of strength is minimized.

As shown in FIGS. 2 to 4, a head entry opening portion 33, into which the thermal head 110 enters, is formed between the supply-side ribbon housing section 31 and the winding-side ribbon housing section 32. The head entry opening portion 33 is penetrated in an approximately rectangular shape and formed to have a width which approximately coincides with a width of the ink ribbon 10 or a width of the thermal head 110, that is, an image-printing width.

In the cartridge main body 13, it is necessary to make the ink ribbon 10 to extend in the head entry opening portion 33. Therefore, in the supply-side ribbon housing section 31, on the head entry opening portion 33 side, an opening portion 34 for a supply-side ribbon is formed, and in the winding-side ribbon housing section 32, on the head entry opening portion 33 side, an opening portion 35 for a winding-side ribbon is formed.

As described above, in the supply-side ribbon housing section 31 and the winding-side ribbon housing section 32, walls constituting them are formed to be thinner than those in the past, so that inner diameters become larger, and thus, the number of windings of the ink ribbon 10 is increased. Further, in the supply-side ribbon housing section 31 and the winding-side ribbon housing section 32, their outer diameters are also larger than those in the past, so that the number of windings of the ink ribbon 10 is increased. Therefore, in particular, in the supply-side ribbon housing section 31, as shown in FIGS. 2 and 3, a portion having a width approximately corresponding to a width of the ink ribbon 10 is formed to be thicker than both end portions 31*a* and 31*a*, and both end portions 31*a* and 31*a* are made to have approximately the same thickness as that of an ink ribbon cartridge in the past. In the supply-side ribbon housing section 31 and the winding-side ribbon housing section 32, due to the fact that the outer diameters are also made to be larger than those in the past, both end portions 31*a* and 31*a* serve as portions, in which pivoting arms of the thermal head 110 avoids. Further, at both end portions 31*a* and 31*a*, a plurality of concave portions 36, into which the pivoting arms of the thermal head 110 enter, are formed.

Also, in the supply-side ribbon housing section 31, an opening portion 28 for the supply spool, which makes the driving hole 18 of the supply spool 11 to face outside, is provided. Also, in the winding-side ribbon housing section 32, an opening portion 29 for the winding spool, which makes the driving hole 18 of the winding spool 12 to face outside, is provided. A side face of the cartridge main body 13, in which the opening portion 28 for the supply spool and the opening portion 29 for the winding spool are provided, becomes an insertion face 27 into the cartridge mounting section 130 of the printer apparatus 100. When the ink ribbon cartridge 1 is mounted in the printer apparatus 100, the driving shafts 102 and 102 of the printer apparatus 100 are engaged with the driving holes 18 and 18 of the spools 11 and 12, which face outside through the opening portion 28 for the supply spool and the opening portion 29 for the winding spool. Specifically, the supply spool 11 or the winding spool 12 is in a state where they are biased by the biasing member such as a coil spring from the end portion on the opposite side to the gear portion 16, so that the gear portion 16 is engaged with the locking projection, and thus, rotation is restricted. When the ink ribbon cartridge is mounted on the cartridge mounting section 130 of the printer apparatus 100, the supply spool 11 or the winding spool 12 is pressed against the driving shafts 102 or 102 of the cartridge mounting section 130, so that an engagement state of the gear portion 16 with the locking projection is released against the biasing force of the coil spring. In this way, the supply spool 11 or the winding spool 12 is in a state where it can be rotated by the driving shafts 102 or 102.

A side face opposite to the insertion face 27 of the cartridge main body 13 becomes a positioning face 26 when the ink ribbon cartridge is mounted on the cartridge mounting section 130 of the printer apparatus 100, as shown in FIGS. 2 and 3. In the positioning face 26, positioning holes 25*a* and 25*b* are formed. The positioning hole 25*a* serves as a reference hole and is formed as an exact circle. Also, the positioning hole 25*b* serves as an adjustment hole and is formed as an oblong hole.

A portion, where the head entry opening portion 33 is provided, between the supply-side ribbon housing section 31 and the winding-side ribbon housing section 32 is opened as an insertion concave portion 30 on the insertion face 27 side which becomes a side face on one side. A side face opposite to the opening is blocked by the positioning face 26, and the positioning holes 25*a* and 25*b* are formed therein.

2-4. Explanation of Supply-side Ribbon Housing Section

Figure 10:
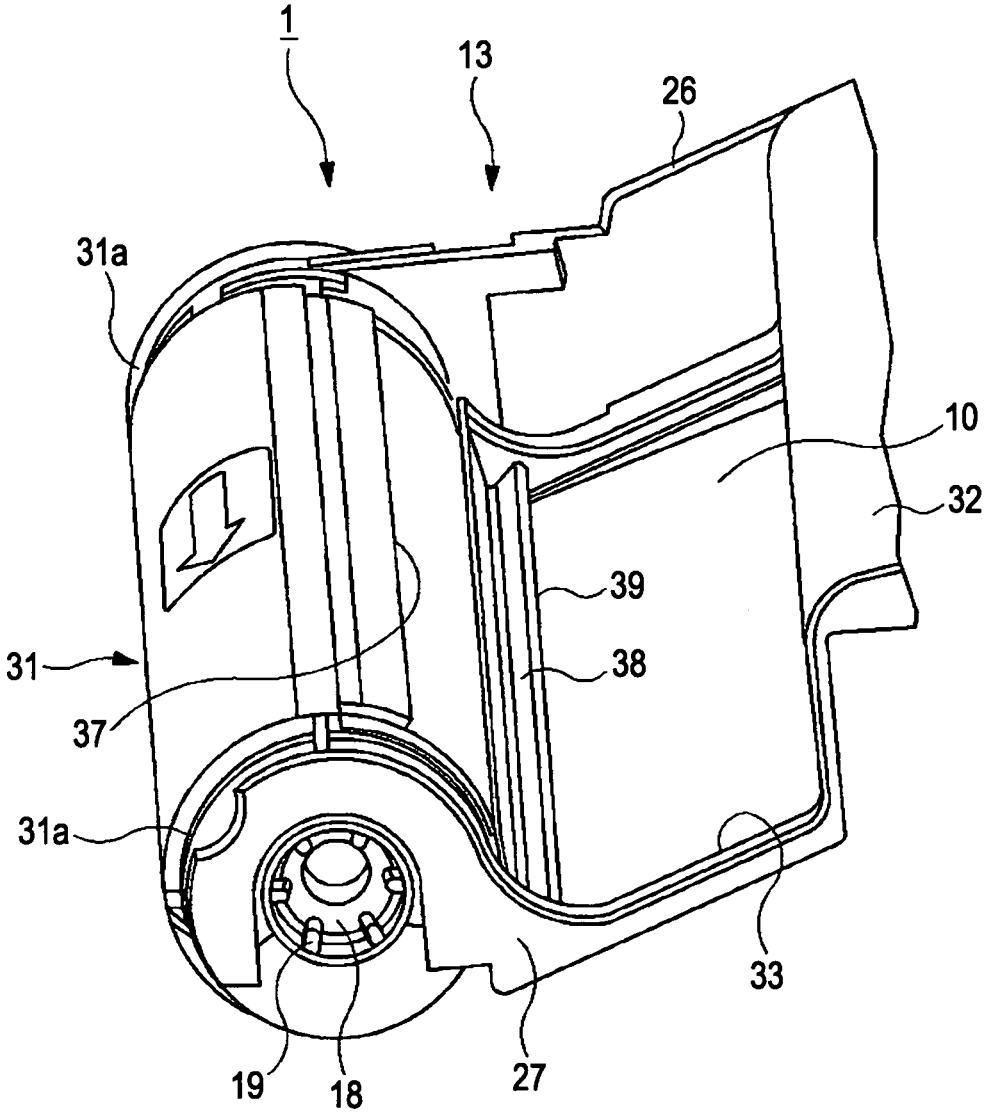
FIG. 10 is a perspective view of a main portion of a supply-side ribbon housing section of a cartridge main body.

Here, in the supply-side ribbon housing section 31, as shown in FIG. 10, an opening portion 37 having a width approximately corresponding to a width of the ink ribbon 10 is formed in a vertical portion of the head entry opening portion 33 side, which is adjacent to the opening portion 34 for a supply-side ribbon. When the ribbon cartridge 1 is mounted on the cartridge mounting section 130 of the printer apparatus 100, the opening portion 37 prevents the supply-side ribbon housing section 31 from coming into contact with a component part of the thermal head 110. That is, on the supply spool 11, the ink ribbon 10 is wound more than in the past. Therefore, when the supply-side ribbon housing section 31 was thickly formed, there is a fear that the supply-side ribbon housing section 31 comes into contact with a component part of the thermal head 110. Therefore, the opening portion 37 prevents a component part of the thermal head 110 from coming into contact with the supply-side ribbon housing section 31. Since the opening portion 37 is provided in a nearly-vertical wall face, incorporation of dust, a fingerprint, fat, or the like into the supply-side ribbon housing section 31 can also be avoided, and the ink ribbon 10 increased by the thickness of the eliminated wall portion and a clearance can be housed in the supply-side ribbon housing section 31.

As shown in FIG. 4, the supply spool 11 with the ink ribbon 10 wound thereon, and the winding spool 12 are respectively housed in the supply-side ribbon housing section 31 and the winding-side ribbon housing section 32 so as to be able to rotate. Here, in the supply spool 11 and the winding spool 12, the ink ribbon is wound on the shaft portions 14 in such a manner that a face with the dye layers of yellow (Y), magenta (M), and cyan (C) and the protection layers formed thereon is located inside. Then, the ink ribbon 10 drawn out from the supply spool 11 extends from the opening portion 34 for a supply-side ribbon to the head entry opening portion 33, then, guided from the opening portion 35 for a winding-side ribbon to the winding-side ribbon housing section 32, and wound on the winding spool 12.

2-5. Explanation of Ribbon Guide Portion

Figure 11:
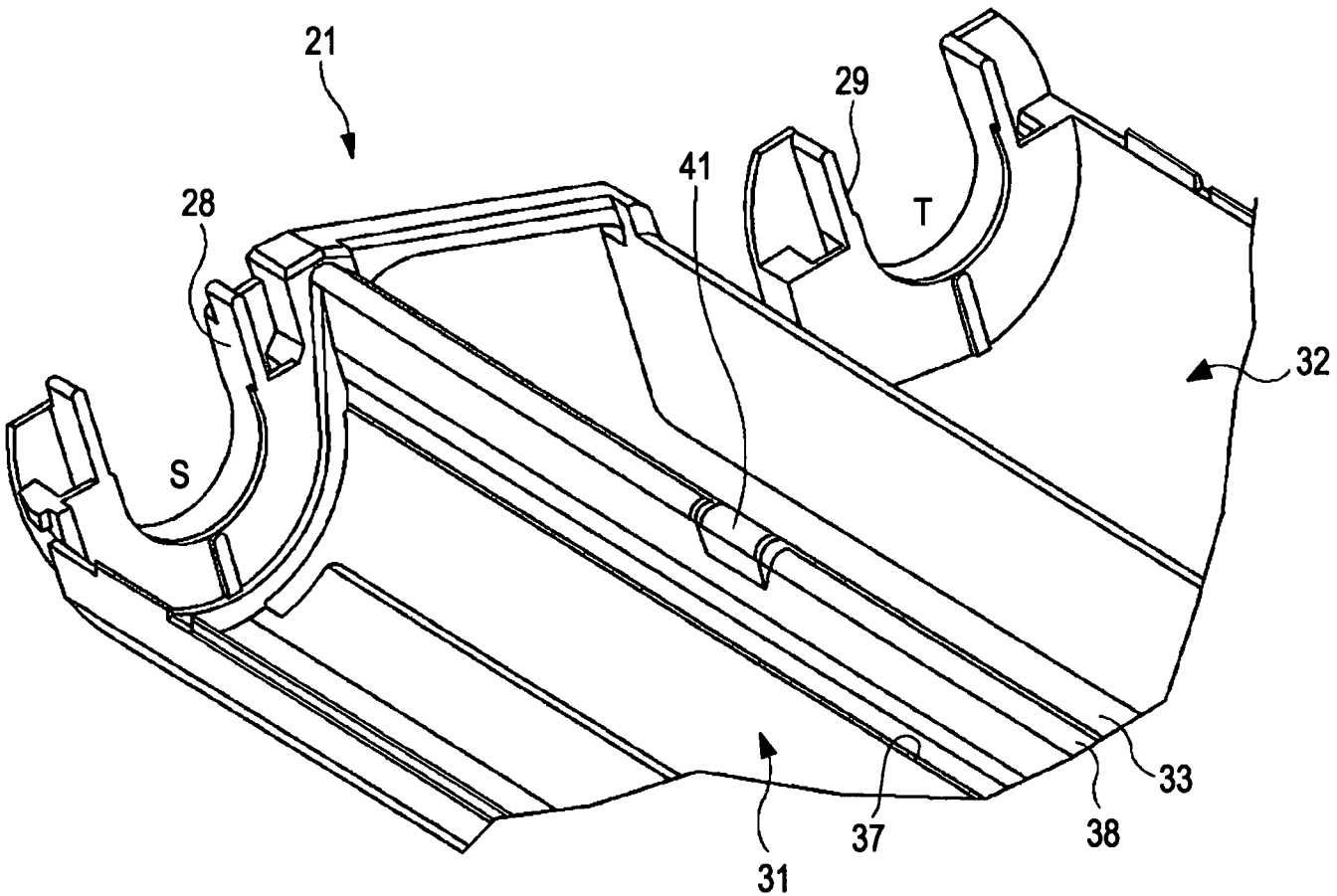
FIG. 11 is a perspective view of a main portion of an upper shell constituting the supply-side ribbon housing section, as viewed from an inner side.

Also, at the opening portion 34 for a supply-side ribbon, a ribbon guide portion 38 which guides the ink ribbon 10 which is sent out is formed. As shown in FIGS. 4, 10, and 11, the ribbon guide portion 38 is provided adjacent to the opening portion 37 which makes the ink ribbon 10 wound on the supply spool 11 to face the head entry opening portion 33 side. The ribbon guide portion 38 has a folded portion 39 folded to the head entry opening portion 33 side and guides the ink ribbon 10 which is sent to the head entry opening portion 33 side, at the folded portion 39. By making the folded amount of the folded portion 39 to be more than that in an ink ribbon cartridge in the past, that is, by making the folded portion 39 be long, strength reduction due to the formation of the opening portion 37 is compensated. In this way, the ribbon guide portion 38 has increased strength, thereby being prevented from being flexure-deformed by an impact or the like, so that the ink ribbon 10 can be sent to the head entry opening portion 33 side in a stable state, and thus, a trouble such as occurrence of image-printing wrinkles can be avoided.

A base end portion of the folded portion 39 is a portion, with which the traveling ink ribbon 10 particularly comes into sliding-contact, and a protrusion portion 41 is formed at the central portion in the width direction of the base end portion of the folded portion 39. The protrusion portion 41 serves as a portion which provides tension to the traveling ink ribbon 10. Since the protrusion portion 41 comes into sliding-contact with the face of the ink ribbon 10, on which the dye layer and so on are provided, the surface thereof is smoothly formed.

Figure 12:
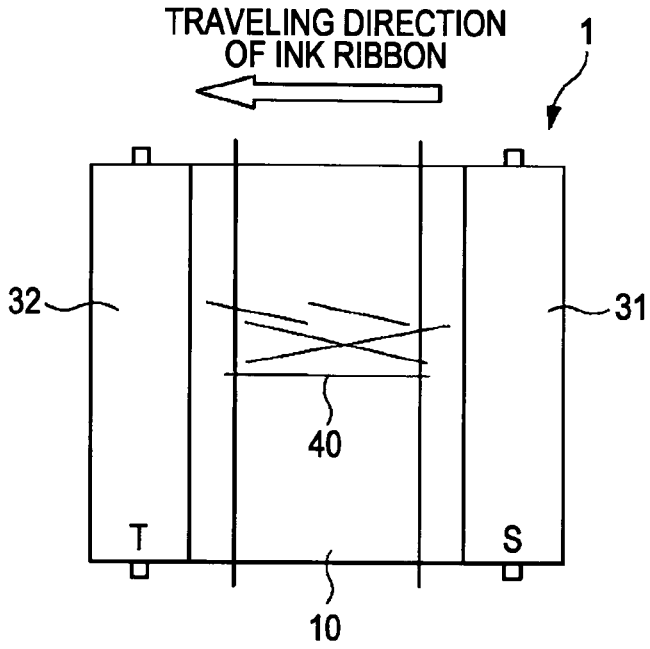
FIG. 12 is a plan view conceptually showing a generation status of wrinkles of an ink ribbon in a case where a protrusion portion is not provided at a ribbon guide portion of the ink ribbon cartridge.
Figure 13:
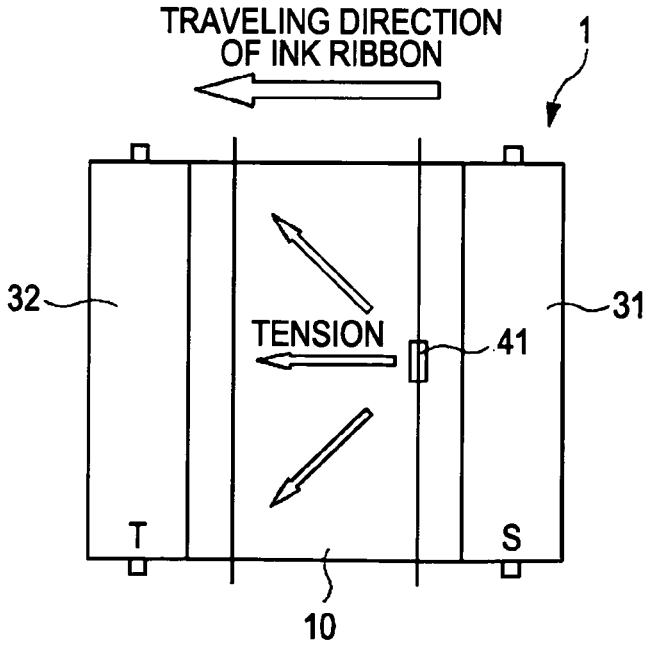
FIG. 13 is a plan view conceptually showing a generation status of wrinkles of an ink ribbon in a case where the protrusion portion is provided at the ribbon guide portion of the ink ribbon cartridge.

Here, FIG. 12 shows a state of the ink ribbon 10 at the head entry opening portion 33 in a case where the protrusion portion 41 is not provided, and FIG. 13 shows a state of the ink ribbon 10 at the head entry opening portion 33 in a case where the protrusion portion 41 is provided. As shown in FIG. 12, the ink ribbon 10 which extends to the head entry opening portion 33 is sent to the head entry opening portion 33 in a state where, if the protrusion portion 41 does not exist, wrinkles are concentrated on the vicinity of the central portion in the width direction of the ink ribbon 10. Therefore, there is a case where wrinkle marks 40 remain at the central portion of an image-printing result. On the contrary, as shown in FIG. 13, in a case where the protrusion portion 41 is provided, at the ink ribbon 10 which extends to the head entry opening portion 33, tension is provided toward both sides from the central portion in the width direction of the ink ribbon 10, which comes into contact with the protrusion portion 41. Therefore, wrinkles can be prevented from occurring at the ink ribbon 10 which extends to the head entry opening portion 33.

In addition, by forming the base end portion of the folded portion 39 such that the central portion in the width direction is highest, a configuration may also be made in which the protrusion portion 41 is not provided. Also in this case, tension can be provided toward both sides from the central portion in the width direction of the ink ribbon 10, which comes into contact with the protrusion portion 41, so that the same effect can be obtained.

2-6. Explanation of Concave Guide Portion

Between the supply-side ribbon housing section 31 and the winding-side ribbon housing section 32, as shown in FIGS. 2 to 4, a concave guide portion 43 acting when the ink ribbon cartridge is mounted on the cartridge mounting section 130 of the printer apparatus 100 is formed adjacent to the winding-side ribbon housing section 32. The concave guide portion 43 is also opened at the insertion face 27 side and the bottom face side of the cartridge main body 13 and blocked at the positioning face 26 side. Also, a guide portion of a convex shape which is provided at the cartridge mounting section 130 of the printer apparatus 100 can be entered into the concave guide portion 43 from an opening on the insertion face 27 side.

The insertion face 27 side of the cartridge main body 13 is supported by engagement of the driving shafts 102 and 102 of the cartridge mounting section 130 with the driving holes 18 of the supply spool 11 and the winding spool 12 when the ink ribbon cartridge is mounted on the cartridge mounting section 130 of the printer apparatus 100. Also, the positioning face 26 of the cartridge main body 13 is supported by engagement of positioning pins on the cartridge mounting section 130 side with the positioning holes 25*a* and 25*b*. As described above, the supply spool 11 and the winding spool 12 are respectively housed in the supply-side ribbon housing section 31 and the winding-side ribbon housing section 32 so as to be able to rotate in a state where they have a certain degree of rattling. Therefore, when the ink ribbon cartridge is mounted on the cartridge mounting section 130, the cartridge main body 13 is in a more unstable state at the insertion face 27 side than the positioning face 26 side. In addition, in the cartridge main body 13, as described above, in order to increase the number of windings of the ink ribbon 10 on the supply spool 11 or the winding spool 12, the upper shell 21*b* and the lower shell 22*b* are formed to be thinner in thickness than in the past, so that strength is reduced, whereby they are easily flexible.

Therefore, in the concave guide portion 43, a projection portion 44, with which the guide portion of a convex shape provided at the cartridge mounting section 130 of the printer apparatus 100 comes into contact, is formed on the insertion face 27 side, where posture is apt to become unstable, at the bottom face of the concave portion. In the cartridge mounting section 130, the guide portion of a convex shape comes into contact with the projection portion 44, so that strength is increased, and thus, flexure deformation in the insertion face 27 side of the cartridge main body 13 can be prevented. Also, the projection portion 44 can keep the insertion face 27 side of the cartridge main body 13 in stable posture. Further, the projection portion 44 is small in protrusion amount from the bottom face of the concave guide portion 43, and therefore, does not become an obstacle at the time of insertion into the cartridge mounting section 130. Therefore, in the cartridge main body 13, the ink ribbon 10 can stably travel. Also, in the winding spool 12, the ink ribbon 10 can be prevented from being wound with biased to one side.

In addition, the projection portion 44 may be provided not only at least on the insertion face 27 side, in which posture of the bottom face of the concave guide portion 43 becomes unstable, but also on the positioning face 26 side, the vicinity of the central position in the longitudinal direction of the concave guide portion 43, or the like. In this way, strength of the cartridge main body 13 is further increased.

2-7. Explanation of Winding-side Ribbon Housing Section

Also in the winding-side ribbon housing section 32 which is provided through the opening portion 34 for a supply-side ribbon and the head entry opening portion 33, which are as described above, in accordance with increase of the number of windings of the ink ribbon 10, an outer diameter is formed to be larger than that in the past in the range of allowing it to be mounted on the cartridge mounting section 130. As shown in FIG. 3, on the bottom face side of the outer surface of the winding-side ribbon housing section 32, concave portions 42 which define a position of a flap which guides the traveling of the image printing medium on the printer apparatus 100 side are formed.

Figure 14A:
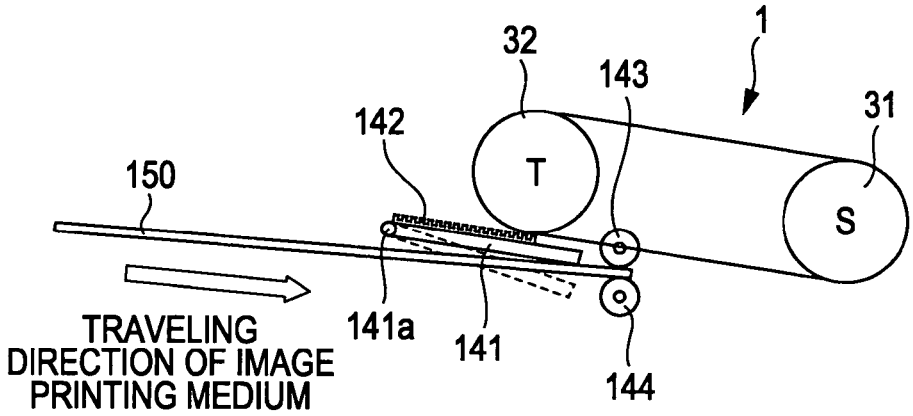
Figure 14B:
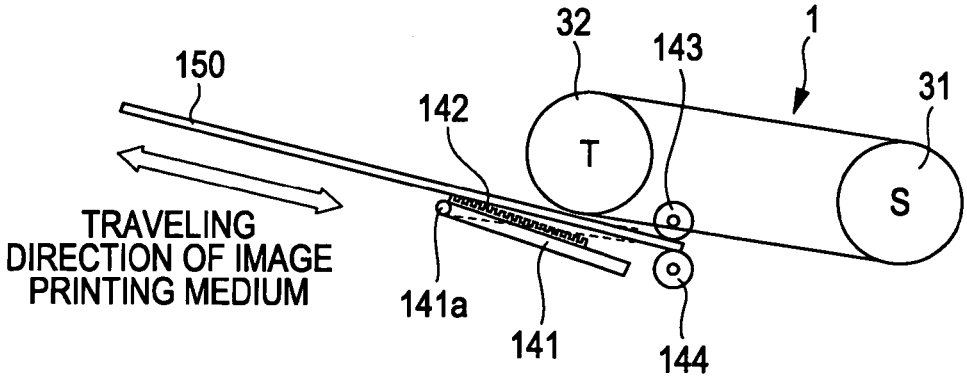

Here, FIGS. 14A and 14B show states of a flap 141 which guides the traveling of the image printing medium 150 of the printer apparatus 100. FIG. 14A shows a state of the flap 141 when the image printing medium 150 is drawn in from the supply tray, and FIG. 14B shows a state of the flap 141 during image printing operation and at the time of discharging.

On the flap 141, a plurality of guide projections 142 are provided parallel to each other in the traveling direction of the image printing medium 150. The flap 141 is provided in the vicinity of the winding-side ribbon housing section 32 of the ink ribbon cartridge 1 mounted on the cartridge mounting section 130. The flap 141 is biased by a biasing member such as a torsion coil spring so as to be pivoted about a pivot shaft 141*a* in a direction of making the flap to be spaced from the winding-side ribbon housing section 32. Also, on the thermal head 110 side of the flap 141, a capstan roller 143 and a pinch roller 144, which constitute a transport mechanism for the image printing medium 150, are provided. The image printing medium 150 is grasped by the capstan roller 143 and the pinch roller 144, thereby being transported in a direction of the thermal head 110 and the platen 120, and then, being in a state where image printing can be performed by the thermal head 110.

As shown in FIG. 14A, when drawing in the image printing medium 150 from the supply tray, the image printing medium 150 drawn in from the supply tray passes below the flap 141, thereby pushing up the flap 141 biased by the biasing member in a direction of making the flap to be spaced from the winding-side ribbon housing section 32. At this time, the guide projections 142 of the flap 141 come into contact with the concave portions 42 of the winding-side ribbon housing section 32 of the cartridge main body 13. In this way, a traveling path is defined by the flap 141, so that the image printing medium 150 is reliably grasped by the capstan roller 143 and the pinch roller 144, thereby being transported in the direction of the thermal head 110.

Therefore, the concave portion 42 of the winding-side ribbon housing section 32 has a depth corresponding to the extent that the diameter of the winding-side ribbon housing section 32 is increased compared to that of an ink ribbon cartridge in the past, and is formed with a thickness which is thinner than the periphery of the depth. In this way, the concave portion 42 defines a position of the flap 141 when drawing in the image printing medium 150 from the supply tray.

Also, as shown in FIG. 14B, during image printing operation and at the time of discharging of the printer apparatus 100, the flap 141 is in a state where the flap is separated from the winding-side ribbon housing section 32 by the biasing force of the biasing member. In this case, the image printing medium 150 passes between the flap 141 and the winding-side ribbon housing section 32, and then, is discharged from the upper side of the supply tray.

2-8. Explanation of Supply-Side Flat Portion and Winding-Side Flat Portion

By the way, as described above, in the supply-side ribbon housing section 31 and the winding-side ribbon housing section 32, the outer diameters are made larger than those in the past so that the number of windings of the ink ribbon 10 is increased. Therefore, the supply-side ribbon housing section 31 and the winding-side ribbon housing section 32 are made to be thicker than a supply-side ribbon housing section and a winding-side ribbon housing section of an ink ribbon cartridge in the past. Therefore, at the supply-side ribbon housing section 31 and the winding-side ribbon housing section 32, as shown in FIGS. 2 to 4, and 9C, in order for the ink ribbon cartridge to be smoothly inserted into the cartridge mounting section 130 of an existing printer apparatus 100, a supply-side flat portion 45 and a winding-side flat portion 46 are formed. Specifically, the supply-side flat portion 45 and the winding-side flat portion 46 are formed at the outer side faces in the longitudinal direction of the supply-side ribbon housing section 31 and the winding-side ribbon housing section 32.

As shown in FIG. 9C, the supply-side flat portion 45 and the winding-side flat portion 46 are flat formed at not only the outer faces, but also the inner faces of the supply-side ribbon housing section 31 and the winding-side ribbon housing section 32. Therefore, the ink ribbons 10 wound on the supply spool 11 and the winding spool 12 come into contact with the inner faces of the supply-side ribbon housing section 31 and the winding-side ribbon housing section 32.

Figure 15A:
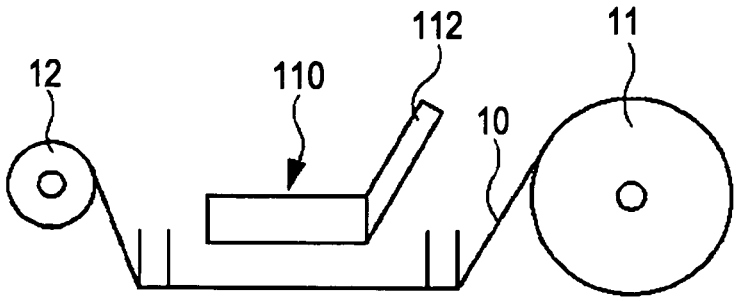
Figure 15B:
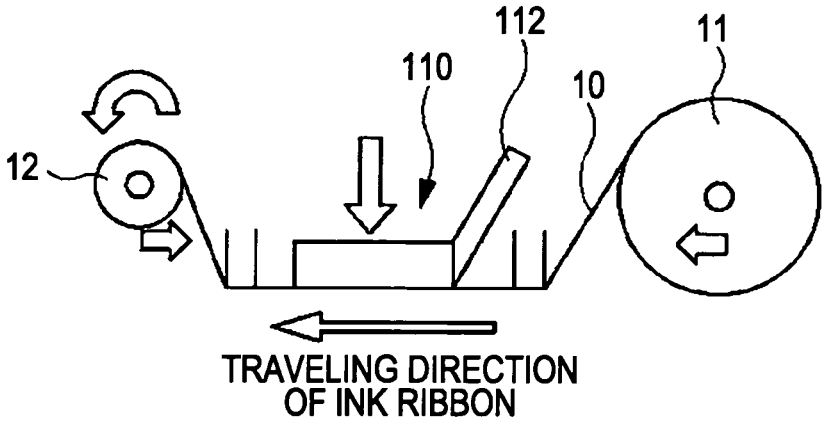

In this regard, when the ink ribbon cartridge 1 is mounted on the cartridge mounting section 130, and when the driving shafts 102 and 102 do not rotate, as shown in FIG. 15A, tension is not applied to the ink ribbon 10. At the time of the image printing of the printer apparatus 100, as shown in FIG. 15B, the driving shafts 102 and 102 are rotationally driven, and the thermal head 110 brings the ink ribbon 10 into pressure-contact with the image printing medium 150. Then, tension which pulls the ink ribbon 10 on the supply spool 11 side and the ink ribbon 10 on the winding spool 12 side to the thermal head 110 side is generated in the ink ribbon 10. According to this, the supply spool 11 in the supply-side ribbon housing section 31 and the winding spool 12 in the winding-side ribbon housing section 32 approach together the head entry opening portion 33 side. Therefore, at the time of the traveling of the ink ribbon 10, the ink ribbons 10 wound on the supply spool 11 and the winding spool 12 are separated from the flat inner faces of the supply-side flat portion 45 and the winding-side flat portion 46. In this way, the ink ribbon 10 is prevented from being damaged due to the contact with the inner faces of the supply-side flat portion 45 and the winding-side flat portion 46.

3. Explanation of Thermal Transfer Type Printer Apparatus

3-1. Explanation of Cartridge Mounting Section

In the printer apparatus 100, on which the ink ribbon cartridge 1 as described above is mounted, as shown in FIGS. 1, 16, and 17, the cartridge mounting section 130, on which the ink ribbon cartridge 1 is mounted, is provided at a frame 101*a* constituting an apparatus main body 101. The cartridge mounting section 130 is provided in succession to the cartridge insertion and removal opening 131 provided in one side face 101*b* which is parallel to the traveling direction of the image printing medium 150. The cartridge mounting section 130 corresponds to a transverse cross-section shape of the ink ribbon cartridge 1, and a supply-side insertion portion 132 and a winding-side insertion portion 133, which correspond to the supply-side ribbon housing section 31 and the winding-side ribbon housing section 32, are provided. Also, in the cartridge mounting section 130, a connection portion insertion portion 134 of a narrow width which connects the supply-side ribbon housing section 31 and the winding-side ribbon housing section 32 of the cartridge main body 13 is provided. The supply-side insertion portion 132 is provided on the back face side of the frame 101*a* constituting the apparatus main body 101, and the winding-side insertion portion 133 is provided on the front face side of the frame 101*a* constituting the apparatus main body 101. The connection portion insertion portion 134 is located between the supply-side insertion portion 132 and the winding-side insertion portion 133 and is a portion, into which the head entry opening portion 33 of the cartridge main body 13 is inserted.

On one side face 101*b* of the frame 101*a*, a positioning piece 135 corresponding to the positioning face 26 of the cartridge main body 13 is formed facing outside above the connection portion insertion portion 134. On the positioning piece 135, positioning projections 136*a* and 136*b* which are engaged with the positioning holes 25*a* and 25*b* formed in the positioning face 26 of the cartridge main body 13 are formed.

The positioning projection 136*a* serves as a reference pin which is engaged with the positioning hole 25*a* of an exact circle, and the positioning projection 136*b* serves as an adjustment pin which is engaged with the positioning hole 25*b* which is an oblong hole.

The ink ribbon cartridge 1 is inserted with the insertion face 27 of the cartridge main body 13 set as an insertion end, the winding-side ribbon housing section 32 located at the front face side of the frame 101*a*, the supply-side ribbon housing section 31 located at the back face side of the frame 101*a*, and the concave portion 42, which defines the position of the flap, located at a lower side. At this time, in the cartridge main body 13, the insertion face 27 side and the bottom face side of the cartridge main body 13 are opened, and the positioning face 26 side is blocked. When the ink ribbon cartridge is inserted into the cartridge mounting section 130 from the cartridge insertion and removal opening 131, the positioning projections 136*a* and 136*b* are engaged with the positioning holes 25*a* and 25*b* from the inner side of the cartridge main body 13.

Also, at the positioning piece 135 on one side face 101*b* of the frame 101*a*, a lock member 137 is provided which prevents the ink ribbon cartridge 1 mounted on the cartridge mounting section 130 from falling from the cartridge mounting section 130. The lock member 137 is provided with a main body portion 137*a* with a lock piece 137*d* formed thereon, an elastic piece 137*b* integrally folded from the main body portion 137*a*, and an operation piece 137*c* integrally formed on the main body portion 137*a*. The elastic piece 137*b* is locked to the frame 101*a*, thereby making the lock piece 137*d* to protrude to the cartridge insertion and removal opening portion 131 side. When the ink ribbon cartridge 1 is mounted on the cartridge mounting section 130, the lock piece 137*d* of the lock member 137 is locked to the positioning face 26 of the cartridge main body 13. According to this, the ink ribbon cartridge 1 is prevented from falling from the cartridge mounting section 130. When taking out the ink ribbon cartridge 1 from the cartridge mounting section 130, the lock piece 137*d* locked to the positioning face 26 is retracted from the cartridge insertion and removal opening portion 131 by operating the operation piece 137*c* against elastic force of the elastic piece 137*b*. In this way, the ink ribbon cartridge 1 can be taken out from the cartridge mounting section 130.

Also, as described above, since the supply-side flat portion 45 and the winding-side flat portion 46 are formed so as to make the outer faces flat, the cartridge main body 13 can be smoothly inserted into the cartridge mounting section 130 without being caught on the end portions of the cartridge insertion and removal opening portion 131.

Also, at the cartridge mounting section 130, a guide portion 138 which enters into and is engaged with the concave guide portion 43 of the ink ribbon cartridge 1 which is mounted on the cartridge mounting section 130 is provided. When the ink ribbon cartridge 1 is inserted into the cartridge mounting section 130 from the cartridge insertion and removal opening portion 131, the guide portion 138 enters into the concave guide portion 43 of the ink ribbon cartridge 1, thereby guiding the insertion. Also, the projection portion 44 formed on the insertion face 27 side, where the posture of the concave guide portion 43 of the ink ribbon cartridge 1 is apt to become unstable, touches the guide portion 138. In this way, in the ink ribbon cartridge 1 mounted on the cartridge mounting section 130, the insertion face 27 side of the cartridge main body 13, where posture is apt to become unstable, is also stably maintained.

3-2. Explanation of Thermal Head and Platen

Figure 16:
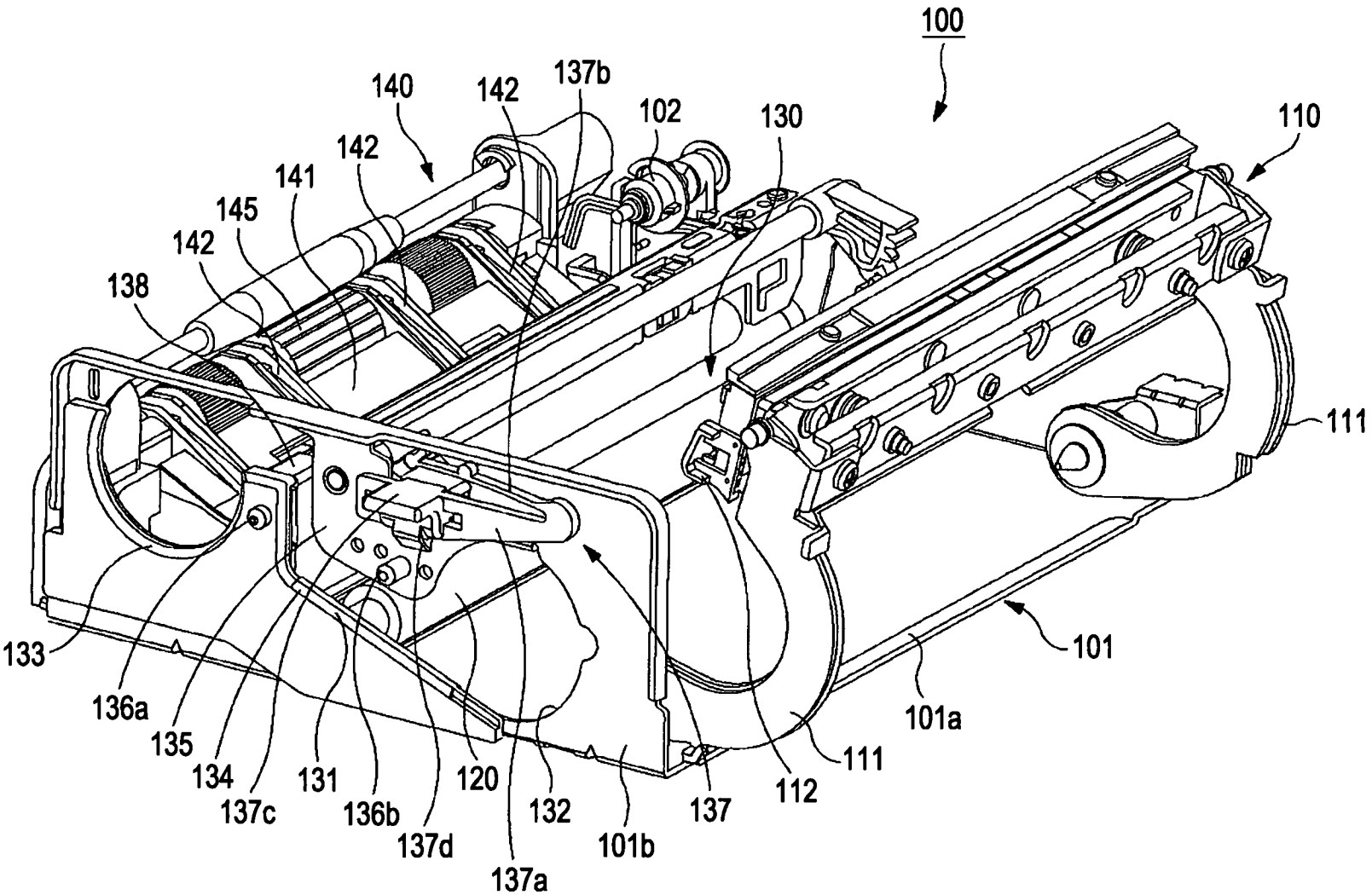
FIG. 16 is a perspective view of the printer apparatus, showing a state when the thermal head is raised and insertion or removal of the ink ribbon cartridge is performed.
Figure 17:
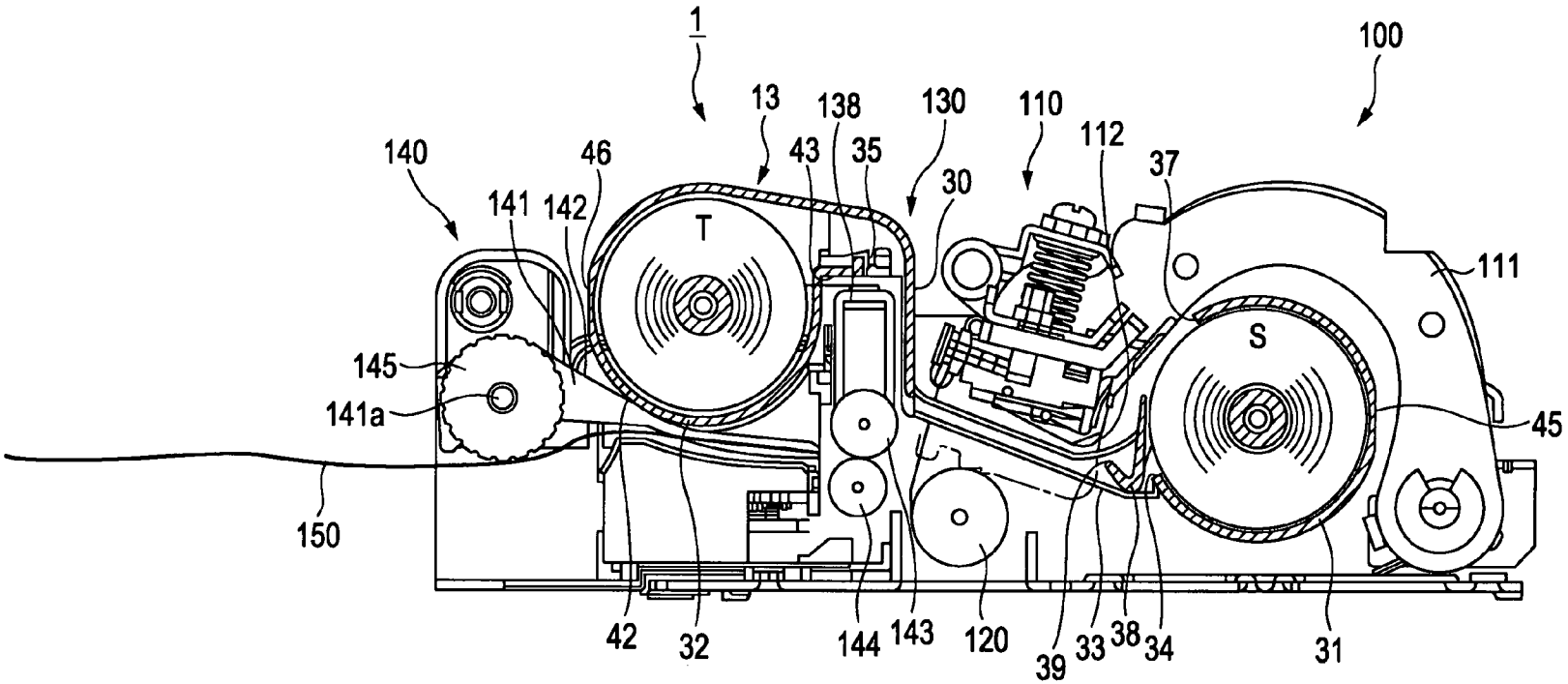
FIG. 17 is a cross-sectional view of the printer apparatus when the image printing medium is drawn in from the supply tray.

Also, the printer apparatus 100 is provided with the thermal head 110 which transfers a color material of the ink ribbon to the image printing medium 150, and the platen 120 which is provided at a position facing the thermal head 110 and supports the ink ribbon and the image printing medium 150, as shown in FIGS. 1, 16, and 17.

The thermal head 110 has a length approximately corresponding to a width of the ink ribbon 10, and a head portion is provided at a heat radiation member. The head portion comes into sliding-contact with the ink ribbon 10, is provided with heater elements linearly arranged corresponding to a maximum printing width, and applies heat energy to the ink ribbon 10 superposed on the image printing medium 150.

At the thermal head 110, a ribbon guide portion 112 which guides traveling of the ink ribbon 10 is further provided. The ribbon guide portion 112 is an approximately L-shaped member which is located in the vicinity of the supply-side insertion portion 132 when the thermal head 110 is at an image printing position. The ribbon guide portion 112 performs guidance such that the ink ribbon 10 drawn out from the opening portion 34 for a supply-side ribbon of the cartridge main body 13 to the head entry opening portion 33 side reliably advances to the head portion of the thermal head 110. In the supply-side ribbon housing section 31, as shown in FIG. 10, the opening portion 37 having a width approximately corresponding to a width of the ink ribbon 10 is formed in an approximately-vertical portion adjacent to the opening portion 34 for a supply-side ribbon, that is, in a vertical portion of the head entry opening portion 33 side. Therefore, also when the ink ribbon cartridge 1 is mounted on the cartridge mounting section 130, the ribbon guide portion 112 which is a component part of the thermal head 110 is prevented from coming into contact with the ink ribbon 10 wound on the supply spool 11.

The long thermal head 110 as described above is supported at both end portions by a pair of pivoting arms 111 and 111. Each of the pivoting arms 111 and 111 is formed into an approximately C-shape, and one end portion thereof is pivotally supported on the back face side of the frame 101*a*. Also, to the other end portion of each of the pivoting arms 111 and 111, each end portion of the thermal head 110 is fixed by a screw or the like. The pivoting arms 111 and 111 are respectively formed into an approximately C-shape, so that they are configured to avoid the supply-side ribbon housing section 31 of the ink ribbon cartridge 1 mounted on the cartridge mounting section 130. In the supply-side ribbon housing section 31, as shown in FIGS. 2 and 3, the portion having a width approximately corresponding to a width of the ink ribbon 10 is formed to be thicker than both end portions 31*a* and 31*a*, both end portions 31*a* and 31*a* have approximately the same thickness as that in an ink ribbon cartridge in the past, and the concave portions 36 where the pivoting arms avoid are formed. Therefore, even if the thermal head 110 is in a state where it has entered into the head entry opening portion 33 of the ink ribbon cartridge 1 mounted on the cartridge mounting section 130, the pivoting arms 111 and 111 do not collide with the supply-side ribbon housing section 31.

The platen 120 is provided at a position which faces the head portion of the thermal head 110 when performing the image printing on the image printing medium 150. The platen 120 is a roller, for example, a rubber roller, having at least a length which is equal to or more than a maximum printing width. The platen 120 grasps the image printing medium 150 and the ink ribbon 10, which are superimposed, in cooperation with the thermal head 110 at the time of the image printing.

3-3. Explanation of Transport Mechanism of Printing Medium

A transport mechanism 140 for the image printing medium 150 is provided on a further front face side than the thermal head 110 of the frame 101*a*. The transport mechanism 140 has a supply roller 145 which draws one by one the image printing medium 150 from the supply tray, which is provided at the front face of the frame 101*a*, into the apparatus main body 101, as shown in FIGS. 16 and 17. The lower side of the supply roller 145 which rotates in a drawing-in direction at the front face of the frame 101*a* comes into contact with the uppermost image printing medium 150 in the supply tray, so that the image printing medium 150 is drawn one by one from the supply tray into the apparatus main body 101.

The transport mechanism 140 further includes the flap 141 which guides traveling of the image printing medium 150 of the printer apparatus 100 side, as described above, the capstan roller 143, and the pinch roller 144.

On the flap 141, a plurality of guide projections 142 are provided parallel to each other in the traveling direction of the image printing medium 150. The flap 141 is provided in the vicinity of the winding-side ribbon housing section 32 in a state where the ink ribbon cartridge 1 is mounted on the cartridge mounting section 130. Also, the flap 141 is biased by the biasing member such as a torsion coil spring in a direction of making the flap to be spaced from the winding-side ribbon housing section 32. On the thermal head 110 side of the flap 141, the capstan roller 143 and the pinch roller 144, which constitute the transport mechanism for the image printing medium 150, are provided. The image printing medium 150 is grasped by the capstan roller 143 and the pinch roller 144, thereby being transported in a direction of the thermal head 110 and the platen 120, and then, can be image-printed by the thermal head 110.

As shown in FIGS. 14A and 17, the image printing medium 150 in the supply tray comes into contact with the lower side of the supply roller 145 which rotates in the drawing-in direction, so that the image printing medium 150 is drawn one by one into the apparatus main body 101. Then, the image printing medium 150 passes below the flap 141, thereby pushing up the flap 141 biased by the biasing member in a direction of making the flap to be spaced from the winding-side ribbon housing section 32. At this time, the guide projections 142 of the flap 141 come into contact with the concave portions 42 of the winding-side ribbon housing section 32 of the cartridge main body 13. In this way, a traveling path is defined by the flap 141, so that the image printing medium 150 is reliably grasped by the capstan roller 143 and the pinch roller 144, thereby being transported in the direction of the thermal head 110.

On the other hand, during image printing operation and at the time of discharging of the printer apparatus 100, the image printing medium 150 passes between the flap 141 and the winding-side ribbon housing section 32, unlike the time of paper feeding. Then, the image printing medium 150 is discharged to the upper side of the supply tray. Specifically, the printed image printing medium 150 comes into contact with the upper side of the supply roller 145 which rotates in the discharging direction, so that the image printing medium is discharged from the upper side of the supply tray.

As described above, the image printing medium 150 has different travelling paths at the time of paper feeding, and during image printing operation and at the time of discharging. However, since the flap 141 comes into contact with the concave portion 42 of the cartridge main body 13 mounted on the cartridge mounting section 130, the travelling paths of the image printing medium 150 can be correctly distinguished.

4. Explanation of Operation

The ink ribbon cartridge 1 constituted as described above is first inserted into the cartridge mounting section 130 with the insertion face 27 of the cartridge main body 13 set as an insertion end, as shown in FIGS. 1, 16, and 17. At this time, the ink ribbon cartridge 1 is inserted with the winding-side ribbon housing section 32 located at the front face side of the frame 101*a*, the supply-side ribbon housing section 31 located at the back face side of the frame 101*a*, and the concave portion 42, which defines the position of the flap, located at a lower side. Then, the positioning projections 136*a* and 136*b* are engaged with the positioning holes 25*a* and 25*b* from the inner side of the cartridge main body 13.

In addition, if the ink ribbon cartridge 1 is mounted on the cartridge mounting section 130, the lock piece 137*d* of the lock member 137 is locked to the positioning face 26 of the cartridge main body 13, thereby preventing the falling of the ink ribbon cartridge 1.

Next, the thermal head 110 which is in a state where it is retracted to a further upper side than the cartridge mounting section 130 enters into the head entry opening portion 33 of the ink ribbon cartridge 1 mounted on the cartridge mounting section 130, by the pivoting of a pair of pivoting arms 111 and 111. At this time, a pair of pivoting arms 111 and 111 are respectively formed into an approximately C-shape, both end portions 31*a* and 31*a* of the supply-side ribbon housing section 31 have approximately the same thickness as that in an ink ribbon cartridge in the past, and the concave portions 36 are also formed. Therefore, the thermal head 110 can be descended up to a given position in the head entry opening portion 33.

If manipulation for printing is made at an operation section of the apparatus main body 101, the supply roller 145 is rotationally driven in a direction of drawing in the image printing medium 150 of the supply tray, so that the uppermost image printing medium 150 of the supply tray is drawn into the apparatus main body 101. Then, the image printing medium 150 passes below the flap 141, thereby pushing up the flap 141 biased by the biasing member in a direction of making the flap to be spaced from the winding-side ribbon housing section 32. At this time, the guide projections 142 of the flap 141 come into contact with the concave portions 42 of the winding-side ribbon housing section 32 of the cartridge main body 13. In this way, a traveling path is defined by the flap 141, so that the image printing medium 150 is reliably grasped by the capstan roller 143 and the pinch roller 144, thereby being transported in the direction of the thermal head 110.

Figure 18:
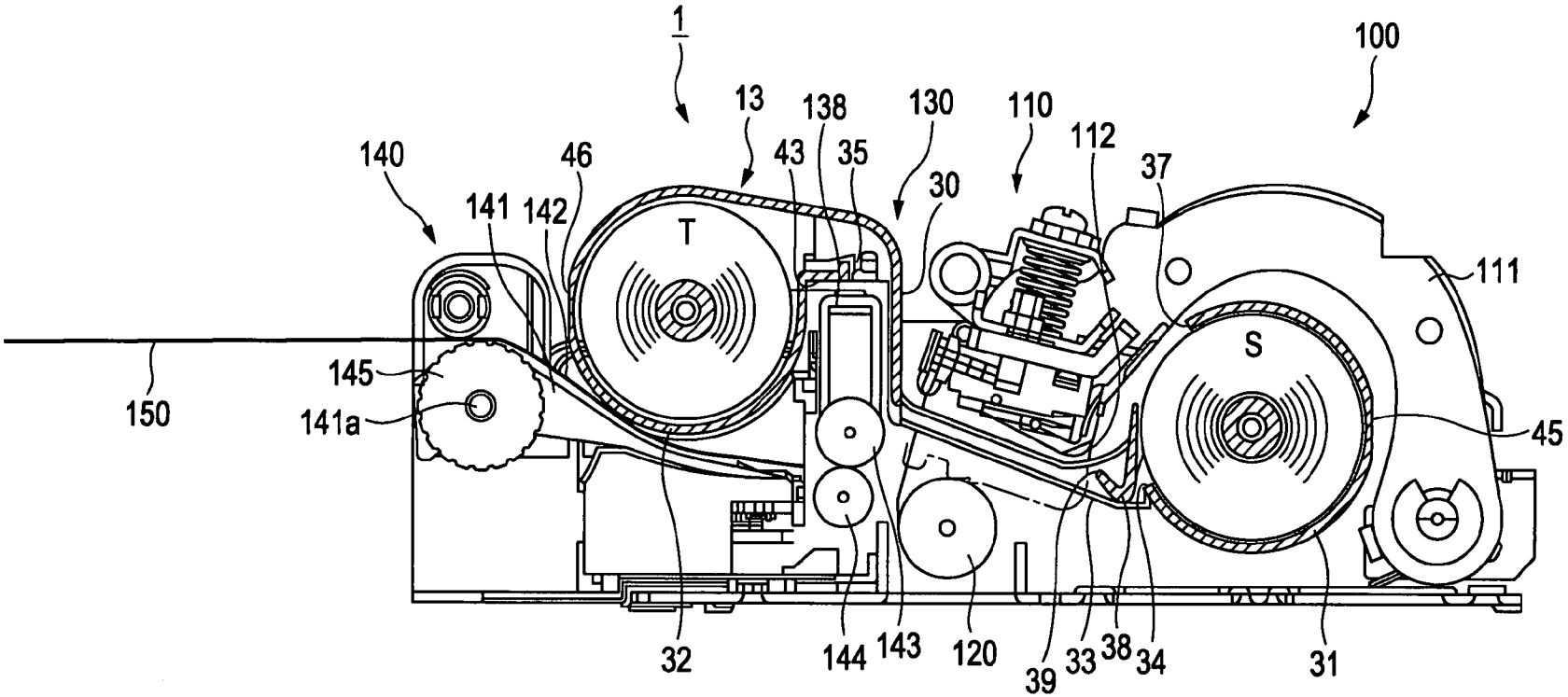
FIG. 18 is a cross-sectional view of the printer apparatus during image printing operation and at the time of discharging.

Next, the image printing medium 150 is grasped along with the ink ribbon 10 by the thermal head 110 and the platen 120. The dye layer, the protection layer, or the like of the ink ribbon 10 comes into pressure-contact with an image printing face of the image printing medium 150, and the dye layer or the protection layer is transferred by heat energy from the thermal head 110 (the position of the thermal head 110 is shown by a dotted line). Specifically, dyes of yellow (Y), magenta (M), and cyan (C) are sequentially sublimed and thermal-transferred in this order to the image printing medium 150 in response to image data, and finally, the protection layer is transferred. As shown in FIG. 18, during image printing operation and at the time of discharging of the printer apparatus 100, the image printing medium 150 passes between the flap 141 and the winding-side ribbon housing section 32. Then, the image printing medium 150 is discharged to the upper side of the supply tray. Specifically, the printed image printing medium 150 comes into contact with the upper side of the supply roller 145 which rotates in the discharging direction, so that the image printing medium is discharged from the upper side of the supply tray.

5. Explanation of Effects

The ink ribbon cartridge 1 according to an embodiment of the present invention contains the ink ribbon 10 for 60 pieces of image printing media, compared to an ink ribbon cartridge in the past which contains an ink ribbon for 40 pieces of image printing media. In order to realize this, in the ink ribbon cartridge 1, a configuration is made such that an outer shape is large within the range of allowing the ink ribbon cartridge to be mounted on the cartridge mounting section 130, and also, the ink ribbon 10 having the number of windings as many as possible can be contained therein.

5-1. Effect 1

That is, in the ink ribbon cartridge 1, as shown in FIGS. 2 and 3, portions having a width approximately corresponding to a width of the ink ribbon 10, of the supply-side ribbon housing section 31 and the winding-side ribbon housing section 32, are made to be thicker than both end portions 31*a* and 31*a*, so that the number of windings of the ink ribbon 10 is increased. According to this, at the opening portion 34 for a supply-side ribbon, as shown in FIG. 10, the opening portion 37 having a width approximately corresponding to a width of the ink ribbon 10 is formed in a vertical portion of the head entry opening portion 33 side, so that contact of the ribbon guide portion 112 which is a component part of the thermal head 110 can be prevented. In addition, since the opening portion 37 is provided in a nearly-vertical wall face, incorporation of dust, a fingerprint, fat, or the like into the supply-side ribbon housing section 31 can be prevented, and also, the ink ribbon 10 increased by the thickness of the eliminated wall portion and a clearance can be housed in the supply-side ribbon housing section 31.

Also, in the ribbon guide portion 38 provided in the vicinity of the opening portion 37 in accordance with the formation of the opening portion 37, as shown in FIGS. 4, 10, and 11, the folded portion 39 is made to be longer than that in an ink ribbon cartridge in the past, so that strength reduction due to the formation of the opening portion 37 is prevented. Therefore, the cartridge main body 13 is prevented from being deformed due to strength reduction. Also, the protrusion portion 41 is provided at the base end portion of the folded portion 39, so that wrinkles is prevented from occurring at the ink ribbon 10 which extends to the head entry opening portion 33.

Also, in the supply-side ribbon housing section 31, both end portions 31*a* and 31*a* are made to have the same thickness as that of a supply-side ribbon housing section of an ink ribbon cartridge 1 in the past, so that a pair of approximately C-shaped pivoting arms 111 and 111 supporting the thermal head 110 can avoid.

As described above, in the ink ribbon cartridge 1, adverse effects attendant upon the thickening of the supply-side ribbon housing section 31 can be overcome by providing the opening portion 37, forming the ribbon guide portion 38 to have a long length, providing the protrusion portion 41, and making both end portions 31*a* and 31*a* to have the same thickness as that in the past.

Also, in the winding-side ribbon housing section 32 side, as shown in FIGS. 14A and 17, the concave portions 42 which define a position of the flap 141 which guides the traveling of the image printing medium 150 are provided in the winding-side ribbon housing section 32. Therefore, a position of the flap 141 when drawing in the image printing medium 150 from the supply tray is not changed from a position in the past. Therefore, adverse effects attendant upon the thickening of the winding-side ribbon housing section 32 can be prevented.

Also, the supply-side ribbon housing section 31 and the winding-side ribbon housing section 32 are provided with the supply-side flat portion 45 and the winding-side flat portion 46, as shown in FIGS. 2 to 4, and 9C. Therefore, the cartridge main body 13 can be smoothly inserted into the cartridge mounting section 130 of an existing printer apparatus 100.

5-2. Effect 2

Also, in the ink ribbon cartridge 1, a configuration is made such that portions where the supply-side ribbon housing section 31 and the winding-side ribbon housing section 32 are formed are made to be thinner in thickness than in the past, so that volumes of them are increased, and therefore, the number of windings of the ink ribbon 10 on the supply spool 11 or the winding spool 12 is increased. Also, with respect to strength reduction due to the thinning of the thickness, in the ink ribbon cartridge 1, the projection portion 44 is formed on the bottom face of the concave guide portion 43 formed adjacent to the winding-side ribbon housing section 32, so that strength is maintained. In addition, the projection portion 44 is provided on the insertion face 27 side where posture is apt to become unstable in the cartridge mounting section 130, so that the ink ribbon cartridge can be mounted on the cartridge mounting section 130 in more stable posture. Also, the cartridge main body 13 is prevented from being deformed due to strength reduction. Also, the protrusion portion 41 is provided at the base end portion of the folded portion 39, so that wrinkles can be prevented from occurring at the ink ribbon 10 which extends to the head entry opening portion 33.

Also, in the ink ribbon cartridge 1, as shown in FIG. 9C, the engagement pieces 23 and 24 which are respectively formed at butting end portions of the upper shell 21 and the lower shell 22 are formed such that the base ends are thick in thickness and the faces facing each other are sloping faces. Therefore, even if the thicknesses of the upper shell 21 and the lower shell 22 are thin, strength can be secured and a mutual contact area can also be sufficiently secured.

Also, in the driving holes 18 of the ink ribbon cartridge 1, as shown in FIGS. 7 and 8, since the number of projecting pieces 19 is further increased than that in the past and each projecting piece 19 is obliquely formed, a position of the supply spool 11 or the winding spool 12 is stable with respect to the driving shaft 102 or 102. Also, gaps between the ink ribbon 10 wound on the supply spool 11 or the winding spool 12 and the inner faces of the cartridge main body 13, that is, the inner faces of the supply-side and winding-side ribbon housing sections are reduced. Therefore, much ink ribbon 10 can be wound on the supply spool 11 or the winding spool 12.

6. Modified Example

In addition, in the above-described example, a case where the ink ribbon 10 for 60 pieces of image printing media is wound in the ink ribbon cartridge 1 has been explained. However, in the present invention, the amount, that is, the number of windings, of the ink ribbon 10 is not to be limited to this. Also, the ink ribbon 10 may also be constituted by the dye layer of black (K) and the protection layer, or may also be constituted by the dye layers of yellow (Y), magenta (M), cyan (C), and black (K), and the protection layers.

The present application contains subject matter related to that disclosed in Japanese Priority Patent Application JP 2009-108246 filed in the Japan Patent Office on Apr. 27, 2009, the entire content of which is hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. An ink ribbon cartridge comprising:

a supply spool, on which an ink ribbon is wound and which is formed at one end portion with a driving hole, with which a driving shaft of a printer apparatus is engaged;

a winding spool which takes up the ink ribbon sent from the supply spool and which is formed at one end portion with a driving hole, with which a driving shaft of the printer apparatus is engaged; and a cartridge main body which has a supply-side ribbon housing section which houses the supply spool so as to be able to rotate about a supply spool axis, and a winding-side ribbon housing section which houses the winding spool so as to be able to rotate about a winding spool axis, and in which a head entry opening portion, into which a thermal head enters, is formed between the supply-side ribbon housing section and the winding-side ribbon housing section, and opening portions for the ribbon, which make the ink ribbon extend in the head entry opening portion, are formed on the head entry opening portion side of the supply-side ribbon housing section and the head entry opening portion side of the winding-side ribbon housing section, wherein in the cartridge main body, an insertion concave portion and a concave guide portion form a structure centrally disposed between and interconnecting the supply-side ribbon housing section and the winding-side ribbon housing section, the insertion concave portion and concave guide portion being separated from one another by a divider wall such that the insertion concave portion defines an insertion concave portion space forming an insertion concave portion opening into a top side and an insertion side of the cartridge main body and the concave guide portion defines a concave guide portion space forming a concave guide portion opening into a bottom side and the insertion side of the cartridge main body, the bottom side being opposite the top side, the concave guide portion acting when mounting the cartridge on a mounting section of the printer apparatus in the insertion direction into the printer apparatus is formed, the concave guide portion spanning the cartridge main body generally in a direction parallel to the supply spool axis and winding spool axis between an insertion face side and a positioning face side, and a projection portion, configured as a stub shaft, is connected to and projects from the divider wall into the concave guide portion space and is disposed at a corner section of the concave guide portion in the insertion concave portion space, the corner section being defined, in part, by the bottom side and the insertion side of the cartridge main body.

2. The ink ribbon cartridge according to claim 1, wherein in the cartridge main body, at an insertion face into the printer apparatus, the driving hole of the supply spool is opened from the supply-side ribbon housing section and also, the driving hole of the winding spool is opened from the winding-side ribbon housing section, and a face on opposite side to the insertion face becomes a positioning face, and the projection portion is formed on the insertion face side of the bottom face of the concave guide portion.

3. The ink ribbon cartridge according to claim 2, wherein at the opening portion for the ribbon of the supply-side ribbon housing section, a ribbon guide portion which guides the ink ribbon which is sent to the head entry opening portion is formed, and the ribbon guide portion is formed such that a central portion is highest.

4. The ink ribbon cartridge according to claim 2 or 3, wherein the cartridge main body is constituted by butting and combining a pair of shells, at butting end portions of the pair of shells, engagement pieces which are engaged with each other are formed, and the respective engagement pieces are formed such that their base ends are thick in thickness and the faces facing each other are sloping faces.

5. The ink ribbon cartridge according to claim 2 or 3, wherein in the driving hole of the supply spool and the driving hole of the winding spool, a plurality of projection pieces, with which the driving shafts of the printer apparatus are engaged, are formed, and the plurality of projection pieces are formed such that edge portions on the center side of the driving hole are inclined so as to form a diameter which is enlarged toward the opening end of the driving hole.

* * * * *